US008949000B2

(12) United States Patent
Fujiwara et al.

(10) Patent No.: US 8,949,000 B2
(45) Date of Patent: Feb. 3, 2015

(54) CONTROL DEVICE AND CONTROL METHOD FOR INTERNAL COMBUSTION ENGINE

(71) Applicants: Takahiko Fujiwara, Susono (JP); Koichi Kimura, Numazu (JP); Kazuhisa Matsuda, Susono (JP)

(72) Inventors: Takahiko Fujiwara, Susono (JP); Koichi Kimura, Numazu (JP); Kazuhisa Matsuda, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/626,515

(22) Filed: Sep. 25, 2012

(65) Prior Publication Data

US 2013/0080033 A1 Mar. 28, 2013

(30) Foreign Application Priority Data

Sep. 26, 2011 (JP) ..... 2011-208619

(51) Int. Cl.
*F02D 41/06* (2006.01)
*F02D 41/00* (2006.01)
*F02D 41/12* (2006.01)

(52) U.S. Cl.
CPC ..... *F02D 41/008* (2013.01); *F02D 41/126* (2013.01); *F02D 2250/21* (2013.01)
USPC ..... 701/104; 123/481; 123/491

(58) Field of Classification Search
CPC ..... F02D 41/0087; F02D 41/062; F02D 41/0255; F02D 41/0035; F02D 2041/0255; F02D 41/028; Y02T 10/26; F01N 13/02; F01N 13/04; F01N 3/0885
USPC ..... 701/104; 123/481, 179.16, 198 F, 491, 123/691, 692; 60/274, 277
See application file for complete search history.

(56) References Cited

U.S. PATENT DOCUMENTS

| | | | | |
|---|---|---|---|---|
| 6,014,859 | A * | 1/2000 | Yoshizaki et al. | 60/285 |
| 6,257,207 | B1 * | 7/2001 | Inui et al. | 123/491 |
| 6,860,833 | B2 * | 3/2005 | Ayabe | 477/121 |
| 6,938,410 | B2 * | 9/2005 | Glugla et al. | 60/284 |
| 7,047,727 | B2 * | 5/2006 | Tanaka et al. | 60/284 |
| 8,225,594 | B2 * | 7/2012 | Kaneko et al. | 60/277 |

FOREIGN PATENT DOCUMENTS

| | | | |
|---|---|---|---|
| EP | 2063090 | A1 | 5/2009 |
| JP | 2005042659 | A | 2/2005 |
| JP | 2005140011 | A | 6/2005 |
| JP | 2006194145 | A | 7/2006 |
| JP | 2007-255355 | A | 10/2007 |
| JP | 2009127559 | A | 6/2009 |

* cited by examiner

*Primary Examiner* — Hai Huynh
*Assistant Examiner* — Gonzalo Laguarda
(74) *Attorney, Agent, or Firm* — Gifford, Krass, Sprinkle, Anderson & Citkowski, P.C.

(57) ABSTRACT

A control device for an internal combustion engine performs rich control when a fuel cutoff operation is terminated and fuel supply to a combustion chamber is restarted, and the engine includes a plurality of the combustion chambers and a fuel supply cycle is repeated. The control device includes a controller configured to set a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers that is different from the first combustion chamber.

12 Claims, 17 Drawing Sheets

CONTROL DEVICE AND CONTROL METHOD FOR INTERNAL COMBUSTION ENGINE

INCORPORATION BY REFERENCE

The disclosure of Japanese Patent Application No. 2011-208619 filed on Sep. 26, 2011 including the specification, drawings and abstract is incorporated herein by reference in its entirety.

BACKGROUND OF THE INVENTION

1. Field of the Invention

The present invention relates to a control device and a control method that are applied to an internal combustion engine in which a fuel cutoff operation is performed to cut off fuel supply to a combustion chamber.

2. Description of Related Art

Conventionally, an internal combustion engine is provided in which a fuel cutoff operation is performed while a specific condition is fulfilled (while the accelerator pedal operation amount for the internal combustion engine is zero, for example) in order, for example, to improve the fuel efficiency of the internal combustion engine. In this kind of an internal combustion engine, the amount of fuel may be adjusted to accomplish various purposes when a fuel cutoff operation is terminated to restart the supply of fuel to the combustion chambers.

For example, one of related art control devices for internal combustion engines (which may also be hereinafter referred to as "related art device") is applied to an internal combustion engine that is provided with a catalyst which cleans the gas (exhaust gas) from the combustion chambers, and controls the amount of fuel so that the air-fuel ratio of the air-fuel mixture that is burned in the combustion chambers becomes richer than the stoichiometric air-fuel ratio when a fuel cutoff operation is terminated to restart the supply of fuel to the combustion chamber. The related art device can thereby adjust the amount of oxygen that is stored in the catalyst (oxygen storage amount) and maintain a state in which the catalyst can clean the exhaust gas with high efficiency (refer to Japanese Patent Application Publication No. 2007-255355 (JP 2007-255355 A), for example).

As described above, the related art device controls the amount of fuel (in other words, the air-fuel ratio of the air-fuel mixture) after the termination of the fuel cutoff operation in view of the exhaust gas cleaning efficiency of the catalyst. More specifically, the air-fuel ratio of the air-fuel mixture has an influence on the amount of oxygen that is contained in the exhaust gas that is generated when the air-fuel mixture is burned. Thus, the oxygen storage amount of the catalyst can be adjusted by controlling the air-fuel ratio of the air-fuel mixture (by adjusting the air-fuel ratio to be richer than the stoichiometric air-fuel ratio as described above, for example) in view of the amount of oxygen that is contained in the exhaust gas that is introduced into the catalyst.

On the other hand, the air-fuel ratio of the air-fuel mixture, in general, also has an influence on the torque that is output from the internal combustion engine (which may also be hereinafter referred to as "output torque"). Thus, when the air-fuel ratio of the air-fuel mixture is adjusted to be richer than the stoichiometric air-fuel ratio after the termination of the fuel cutoff operation, the output torque after the fuel cutoff operation becomes higher than the output torque before the fuel cutoff operation. In other words, the output torque increases after the fuel cutoff operation is terminated.

The degree of change in output torque as described above (which may also be hereinafter referred to as "torque variation") is considered to depend on various parameters (for example, the air-fuel ratio after the fuel cutoff operation is terminated, and features of the internal combustion engine such as engine displacement, cylinder arrangement and firing order). Therefore, it may be considered that depending on the parameters, the magnitude of torque variation does not necessarily become so large as to substantially affect the operation of the internal combustion engine. However, it is desirable to reduce the magnitude of torque variation as much as possible.

SUMMARY OF THE INVENTION

The present invention provides a control device and a control method for an internal combustion engine which reduce the magnitude of torque variation as much as possible even when the air-fuel ratio of an air-fuel mixture is controlled to be richer than the stoichiometric air-fuel ratio after the termination of a fuel cutoff operation.

A control device for an internal combustion engine according to an aspect of the invention performs "rich control" to control an amount of fuel supplied to a combustion chamber of the internal combustion engine so that an air-fuel ratio of an air-fuel mixture burned in the combustion chamber is richer than a stoichiometric air-fuel ratio, when "a fuel cutoff operation" in which supply of the fuel to the combustion chamber is cut off is terminated and the supply of the fuel to the combustion chamber is restarted.

The "fuel cutoff operation" is, in general, performed during a period in which a specific condition determined taking into account the operating state of the internal combustion engine is fulfilled. For example, the fuel cutoff operation may be performed when the internal combustion engine is required to produce low torque (when the accelerator pedal operation amount is zero, for example) or when the internal combustion engine is determined to be able to continue to operate even when the supply of fuel is cut off (when the engine rotational speed is equal to or higher than a predetermined threshold value, for example).

The "air-fuel mixture that is burned" is not specifically limited as long as it is a gas that contains fuel whose amount is controlled by the control device according to the above aspect of the present invention, and air. For example, as the air-fuel mixture that is burned, gas which is produced by mixing air and fuel outside the combustion chambers and then introduced into the combustion chambers (i.e., gas that is produced by what is called port injection, for example) or gas which is produced by mixing air and fuel in the combustion chambers (i.e., gas that is produced by what is called in-cylinder injection) may be adopted.

The term "stoichiometric air-fuel ratio" refers, as is well known, to an air-fuel ratio (approximately 14.7 in mass ratio) at which air and fuel react with each other without excess or deficiency when the air-fuel mixture is burned. The "air-fuel ratio which is richer than a stoichiometric air-fuel ratio" means, as is well known, the air-fuel ratio of an air-fuel mixture which contains a greater amount of fuel per unit amount than an air-fuel mixture which has the stoichiometric air-fuel ratio (in other words, an air-fuel ratio lower than the stoichiometric air-fuel ratio). In contrast, an "air-fuel ratio which is leaner than a stoichiometric air-fuel ratio" means, as is well known, the air-fuel ratio of an air-fuel mixture which contains a smaller amount of fuel per unit amount than an air-fuel mixture which has the stoichiometric air-fuel ratio (in other words, an air-fuel ratio higher than the stoichiometric air-fuel ratio).

In the following, an air-fuel ratio which is richer than the stoichiometric air-fuel ratio may also be referred to simply as "rich air-fuel ratio" and an air-fuel ratio which is leaner than the stoichiometric air-fuel ratio may also be referred to simply as "lean air-fuel ratio" for the sake of convenience.

The purpose of performing the "rich control" is not specifically limited. For example, the rich control may be performed for the purpose of maintaining a state where the catalyst that is used to clean the exhaust gas from the combustion chambers can clean the exhaust gas with high efficiency as described later. In addition, the specific value of the air-fuel ratio at which the rich control is performed is not specifically limited. For example, the air-fuel ratio at which the rich control is performed may be set to a suitable value for, for example, the operating state of the internal combustion engine, the performances of the components which constitute the internal combustion engine (the catalyst, for example), and the purpose of performing the rich control.

When the rich control is performed, torque variation may occur because the air-fuel ratio of the air-fuel mixture has an influence on the output torque of the internal combustion engine as described above. For example, in the case where the internal combustion engine includes a plurality of combustion chambers, the internal combustion engine is, in general, operated by repeating a series of processes in which fuel is sequentially supplied to the combustion chambers (which may also be hereinafter referred to as "fuel supply cycle") and a series of processes in which the fuel that is supplied as described above is burned sequentially. It is considered that when the rich control is performed in all the combustion chambers in the same (one) fuel supply cycle in the internal combustion engine, the output torque of the internal combustion engine may increase rapidly and the magnitude of torque variation may become so large that the operation of the internal combustion engine may be substantially affected.

In the above-described aspect of the invention, the internal combustion engine includes a plurality of the combustion chambers and a fuel supply cycle in which the fuel is sequentially supplied to the plurality of combustion chambers is repeated. The control device includes a controller configured to set a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers that is different from the first combustion chamber.

Thus, the rich control in one of the plurality of combustion chambers (first combustion chamber) and the rich control in another combustion chamber (second combustion chamber) are started in different fuel supply cycles. In other words, the rich control is started over a plurality of fuel supply cycles. Thus, even when the rich control is performed after the fuel cutoff operation is terminated, the magnitude of torque variation is reduced as compared to the case where the rich control is started in all the combustion chambers in the same (one) fuel supply cycle.

As can be understood from the above description, the order of performing the "fuel supply cycle which includes the first moment" and the "fuel supply cycle which includes the second moment" is not specifically limited as long as they are different fuel supply cycles. In addition, the "fuel supply cycle which includes the first moment" and the "fuel supply cycle which includes the second moment" may or may not be consecutive fuel supply cycles. In other words, the "fuel supply cycle which includes the second moment" may be performed as a fuel supply cycle immediately after the "fuel supply cycle which includes the first moment," or one or more fuel supply cycles may be interposed between the "fuel supply cycle which includes the first moment" and the "fuel supply cycle which includes the second moment."

The arrangement (layout) of the "plurality of combustion chambers" in the internal combustion engine is not specifically limited. For example, the internal combustion engine may be constituted such that the central axes of the combustion chambers are arranged on one plane (what is called an in-line engine). Alternatively, the internal combustion engine may be, for example, constituted such that the central axes of combustion chambers that belong to one group and the central axes of combustion chambers that belong to the other group are arranged on two different planes (banks) (what is called a V-engine, for example).

The number of combustion chambers that are involved in the fuel supply cycle is not specifically limited. For example, the number of combustion chambers that are involved in one fuel supply cycle may be equal to the number of the plurality of combustion chambers or may be greater than the number of the plurality of combustion chambers (a number that is obtained by multiplying the number of the plurality of combustion chambers by a natural number, for example).

The control device according to some modes of the present invention (first to sixth modes) are described below.

(First mode) The air-fuel mixture burned in the combustion chambers of the internal combustion engine is discharged from the combustion chambers. The gas (exhaust gas) that is discharged from the combustion chambers contains, in general, various substances such as nitrogen oxides (NOx) and unburned matters. The amount of the discharged substances (emissions) is preferably reduced as much as possible. Thus, there have been proposed internal combustion engines provided with a catalyst that removes these substances from the exhaust gas to clean the exhaust gas.

The term "to clean the exhaust gas" signifies removing at least some portions of substances to be cleaned, such as nitrogen oxides and unburned matters, from the exhaust gas, and does not necessarily signify removing the substances to be cleaned completely from the exhaust gas.

The exhaust gas cleaning performance of a catalyst may be deteriorated for various reasons. For example, the exhaust gas cleaning performance of a catalyst may be deteriorated when a substance that constitutes the catalyst (such as a noble metal, oxygen storage substance or carrier) is exposed to high-temperature exhaust gas and thermally denatured or when a component that is contained in the exhaust gas adheres to a substance that constitutes the catalyst. In other words, the exhaust gas cleaning performance of a catalyst may be deteriorated depending on the condition of the exhaust gas introduced into the catalyst (such as temperature, oxygen concentration and the amounts of components that are contained in the exhaust gas). The phenomenon in which the exhaust gas cleaning performance of a catalyst is deteriorated may also be hereinafter referred to as the "catalyst is deteriorated."

In the case where the internal combustion engine includes a plurality of catalysts, it is considered desirable that the degrees of deterioration of the catalysts should be as equal as possible from the viewpoint of reducing emissions.

Thus, in the control device according to a first mode of the present invention, in a case where the internal combustion engine includes a first catalyst into which gas from the first combustion chamber is introduced and a second catalyst into which gas from the second combustion chamber is introduced, the controller may be configured to set the first moment and the second moment based on a deterioration level of the first catalyst and a deterioration level of the second catalyst.

According to the configuration described above, the timings at which the exhaust gas generated as a result of the rich control starts to be introduced into the catalysts (in other words, the timings at which the introduction of the exhaust gas generated during the fuel cutoff operation (in other words, air) into the catalysts is ended) can be set taken into account the degree of deterioration (deterioration level) of each catalyst. Thus, the deterioration level of the first catalyst and the deterioration level of the second catalyst can be kept as equal as possible.

The "catalyst" is not specifically limited as long as it can clean exhaust gas. For example, a three-way catalyst or an NOx storage-reduction catalyst may be adopted as the catalyst.

The "deterioration level of the catalyst" is not specifically limited as long as it is an index which can represent the degree of decrease in exhaust gas cleaning performance of the catalyst with respect to the exhaust gas cleaning performance that the catalyst originally has (the catalyst in a new (unused) state has, for example). For example, the deterioration level of the catalyst can be acquired based on the minimum value of the temperature of the catalyst that is required to reduce the amount of a specific component contained in the exhaust gas to a specific extent (to reduce the amount of NOx by 50%, for example). Alternatively, the deterioration level of the catalyst can be acquired based on the maximum value of the amount of oxygen that can be stored in the catalyst (maximum oxygen intake, in other words, maximum oxygen storage amount), for example. Alternatively, the deterioration level of the catalyst may be acquired based on the amount of a component (such as a sulfur component) that has been stored or adsorbed in the catalyst, for example. In the present invention, the greater the value of the deterioration level of a catalyst, the higher the degree of decrease in the exhaust gas cleaning performance of the catalyst.

Specific examples of the first mode are described below as second to fifth modes.

(Second mode) The inventors conducted various experiments and studies on the relationship between the condition of the gas that is introduced into a catalyst and the deterioration level of the catalyst. According to the experiments and studies by the inventors, it was found that the degree of progress of deterioration of a catalyst (in other words, the degree of increase in the deterioration level of a catalyst) depends on the amount of oxidizing substances or reducing substances that are contained in the gas that is introduced into the catalyst (in other words, whether the catalyst is in an oxidation atmosphere or reduction atmosphere) and the temperature of the catalyst.

More specifically, it was found that in the case where the temperature of the catalyst is higher than a specific temperature, the deterioration level of the catalyst increases when gas with a lean air-fuel ratio is introduced into the catalyst (in other words, the catalyst is in an oxidation atmosphere) as compared to when gas with a rich air-fuel ratio is introduced into the catalyst (in other words, the catalyst is in a reduction atmosphere). It was also found that in the case where the temperature of the catalyst is, in contrast, equal to or lower than the specific temperature, the deterioration level of the catalyst increases when gas with a rich air-fuel ratio is introduced into the catalyst (in other words, the catalyst is in the reduction atmosphere) as compared to when gas with a lean air-fuel ratio is introduced into the catalyst (in other words, the catalyst is in the oxidation atmosphere). In addition, it was concluded from these findings that the degree of increase in the deterioration level of a catalyst can be adjusted by adjusting the length of time for which the fuel cutoff operation is continued (in other words, the length of time for which gas with a lean air-fuel ratio is introduced into the catalyst) depending on the temperature of the catalyst.

In other words, it was found that the degree of increase in the deterioration level of a catalyst decreases as the length of time for which the fuel cutoff operation is continued is "shorter" when the temperature of the catalyst is higher than a specific temperature, and the degree of increase in the deterioration level of a catalyst decreases as the length of time for which the fuel cutoff operation is continued is "longer" (taking into account the rich control performed after the fuel cutoff operation) when the temperature of the catalyst is equal to or lower than the specific temperature.

In the control device according to a second mode of the present invention, the controller may be configured, in a case where the deterioration level of the first catalyst is "higher" than the deterioration level of the second catalyst, (A) to set the first moment and the second moment such that the fuel supply cycle which includes the first moment is performed "before" performing the fuel supply cycle which includes the second moment when at least the first catalyst of the first and second catalysts has a temperature "higher" than a threshold value temperature, and (B) to set the first moment and the second moment such that the fuel supply cycle which includes the first moment is performed "after" performing the fuel supply cycle which includes the second moment when at least the first catalyst has a temperature "equal to or lower than" the threshold value temperature.

According to the above-described configuration, when the temperature of the catalyst with a higher deterioration level (first catalyst) is higher than a specific temperature (threshold value temperature) (i.e., in the above-described case (A)), the timing (first moment) at which the rich control is started in the combustion chamber which discharges the exhaust gas that is introduced into the catalyst with the higher deterioration level (first catalyst) is earlier than the timing (second moment) at which the rich control is started in the combustion chamber which discharges the exhaust gas that is introduced into the catalyst with a lower deterioration level (second catalyst). In other words, the fuel cutoff operation is terminated earlier in the combustion chamber which discharges the exhaust gas that is introduced into the catalyst with the higher deterioration level (first catalyst).

In other words, the length of time, for which gas with a lean air-fuel ratio (exhaust gas that is generated during the fuel cutoff operation) is introduced into the catalyst with the higher deterioration level (first catalyst), is "decreased." In contrast, the length of time, for which the gas with the lean air-fuel ratio is introduced into the catalyst with the lower deterioration level (second catalyst), is "increased." Thus, the degree of increase in the deterioration level of the catalyst with the higher deterioration level (first catalyst) is lower than the degree of increase in the deterioration level of the catalyst with the lower deterioration level (second catalyst). As a result, the difference between the deterioration level of the first catalyst and the deterioration level of the second catalyst decreases. Thus, the deterioration level of the first catalyst and the deterioration level of the second catalyst can be kept as equal as possible.

In contrast, when the temperature of the catalyst with the higher deterioration level (first catalyst) is "equal to or lower" than the specific temperature (the threshold value temperature) (i.e., in the above-described case (B)), the length of time, for which the gas with the lean air-fuel ratio (exhaust gas that is generated during the fuel cutoff operation) is introduced into the catalyst with the higher deterioration level (first catalyst), is "increased" and the length of time, for which the gas with the lean air-fuel ratio (exhaust gas that is generated during the fuel cutoff operation) is introduced into the catalyst with the lower deterioration level (second catalyst), is "decreased." Thus, as is the case described above, the degree of increase in the deterioration level of the catalyst with the higher deterioration level (first catalyst) is lower than the degree of increase in the deterioration level of the catalyst with the lower deterioration level (second catalyst). Thus, the deterioration level of the first catalyst and the deterioration level of the second catalyst can be kept as equal as possible.

The above-described case where "at least" the first catalyst has a temperature higher than a threshold value temperature includes both of the case where both the first and second catalysts have temperatures higher than the threshold value temperature, and the case where the first catalyst has a temperature higher than the threshold value temperature and the second catalyst has a temperature equal to or lower than the threshold value temperature. Similarly, the above-described case where "at least" the first catalyst has a temperature equal to or lower than a threshold value temperature includes both of the case where both the first and second catalysts have temperatures equal to or lower than the threshold value temperature and the case where the first catalyst has a temperature equal to or lower than the threshold value temperature and the second catalyst has a temperature higher than the threshold value temperature. As can be understood from the above description, the difference between the deterioration level of the first catalyst and the deterioration level of the second catalyst decreases in either case when the first and second moments are set as described above (in the cases (A) and (B)).

(Third mode) According to the further experiments and studies by the inventors, it was found that the temperature of a catalyst decreases to the specific temperature described above (refer to the third aspect) or lower when the amount of gas introduced into the catalyst during the fuel cutoff operation is greater than a specific amount.

In the control device according to a third mode of the present invention, the controller may be configured, in a case where the deterioration level of the first catalyst is higher than the deterioration level of the second catalyst, (C) to set the first moment and the second moment such that the fuel supply cycle which includes the first moment is performed "after" performing the fuel supply cycle which includes the second moment when a total amount of the gas introduced into at least the first catalyst of the first and second catalysts during the fuel cutoff operation is "greater" than a threshold value, and (D) to set the first moment and the second moment such that the fuel supply cycle which includes the first moment is performed "before" performing the fuel supply cycle which includes the second moment when the total amount of the gas introduced into at least the first catalyst during the fuel cutoff operation is "equal to or smaller than" the threshold value.

According to the configuration described above, when the total amount of the gas introduced into the catalyst with a higher deterioration level (first catalyst) during the fuel cutoff operation is greater than a threshold amount (i.e., in the above-described case C), the timing (first moment) at which the rich control is started in the combustion chamber that discharges the exhaust gas that is introduced into the catalyst with the higher deterioration level (first catalyst) is later than the timing (second timing) at which the rich control is started in the combustion chamber that discharges the exhaust gas that is introduced into the catalyst with a lower deterioration level (second catalyst). In other words, the fuel cutoff operation is terminated later in the combustion chamber which discharges the exhaust gas that is introduced into the catalyst with the higher deterioration level (first catalyst).

In other words, the length of time, for which gas with a lean air-fuel ratio (exhaust gas that is generated during the fuel cutoff operation) is introduced into the catalyst with the higher deterioration level (first catalyst), is "increased" and the length of time, for which the gas with the lean air-fuel ratio (exhaust gas that is generated during the fuel cutoff operation) is introduced into the catalyst with the lower deterioration level (second catalyst), is "decreased." Thus, the degree of increase in the deterioration level of the catalyst with the higher deterioration level (first catalyst) is lower than the degree of increase in the deterioration level of the catalyst with the lower deterioration level (second catalyst). As a result, the deterioration level of the first catalyst and the deterioration level of the second catalyst can be kept as equal as possible.

In contrast, when the total amount of the gas introduced into the catalyst with the higher deterioration level (first catalyst) during the fuel cutoff operation is equal to or smaller than the threshold amount (i.e., in the above-described case D), the length of time, for which the gas with the lean air-fuel ratio (exhaust gas that is generated during the fuel cutoff operation) is introduced into the catalyst with the higher deterioration level (first catalyst), is "decreased" and the length of time, for which the gas with the lean air-fuel ratio (exhaust gas that is generated during the fuel cutoff operation) is introduced into the catalyst with the lower deterioration level (second catalyst), is "increased." Thus, as is the case described above, the deterioration level of the first catalyst and the deterioration level of the second catalyst can be kept as equal as possible.

The above-described case where a total amount of the gas introduced into "at least" the first catalyst is greater than a threshold amount includes both of the case where the total amount of the gas introduced into the first catalyst and the total amount of the gas introduced into the second catalyst are both greater than the threshold amount, and the case where the total amount of the gas introduced into the first catalyst is greater than the threshold amount and the total amount of the gas introduced into the second catalyst is equal to or smaller than the threshold amount. Similarly, the above-described case where the total amount of the gas introduced into "at least" the first catalyst is equal to or smaller than the threshold amount includes both of the case where the total amount of the gas introduced into the first catalyst and the total amount of the gas introduced into the second catalyst are both equal to or smaller than the threshold amount, and the case where the total amount of the gas introduced into the first catalyst and is equal to or smaller than the threshold amount and the total amount of the gas introduced into the second catalyst is greater than the threshold amount. As can be understood from the above description, the difference between the deterioration level of the first catalyst and the deterioration level of the second catalyst decreases in either case when the first and second moments are set as described above (in the cases C and D).

In addition, in the control device according to the third mode, the controller may set the first and second moments based on whether the "sum of the total amount of the gas introduced into the first catalyst during the fuel cutoff operation and the total amount of the gas introduced into the second catalyst during the fuel cutoff operation" is greater than a specific amount instead of based on whether the "total amount of the gas introduced into at least the first catalyst" is greater than the threshold amount.

(Fourth mode) As described above, in the control devices according to the second and third modes, the controller is configured to decrease the difference between the deterioration level of the first catalyst and the deterioration level of the second catalyst to keep the deterioration levels as equal as possible "when the deterioration level of the first catalyst and the deterioration level of the second catalyst have been acquired and the deterioration level of the first catalyst is different from the deterioration level of the second catalyst"

In contrast, in the control device according to a fourth mode of the present invention, the controller may be configured, "when at least one of the deterioration level of the first catalyst and the deterioration level of the second catalyst has not been acquired" or when the deterioration level of the first catalyst is "equal to" the deterioration level of the second catalyst, to set the first moment and the second moment that are associated with the current fuel cutoff operation based on "history" of the first moment and the second moment that are associated with the fuel cutoff operation performed prior to the current fuel cutoff operation.

According to the configuration described above, the timings at which exhaust gas is introduced into the first and second catalysts by the rich control after the current fuel cutoff operation can be set (the first and second moments can be set) taking into account the information on the rich control performed after the fuel cutoff operation in the past (history of the first and second moments). Thus, the deterioration level of the first catalyst and the deterioration level of the second catalyst can be kept as equal as possible.

As can be understood from the above description, the "first and second moments that are associated with the fuel cutoff operation" described above means the first and second moments relating to the rich control that is performed after the fuel cutoff operation is terminated.

The "history of the first and second moments" described above is not specifically limited as long as it is information on the first and second moments that are associated with the fuel cutoff operation performed before the current fuel cutoff operation. For example, as the history of the first and second moments, information on the first and second moments that are associated with one or more fuel cutoff operations performed before the current fuel cutoff operation may be adopted. More specifically, as the history of the first and second moments, the order of the first and second moments that are associated with the (previous) fuel cutoff operation performed immediately prior to the current fuel cutoff operation may be adopted, for example. Alternatively, as the history of the first and second moments, the order and the number of times of the first and second moments that are associated with a plurality of fuel cutoff operations performed before the current fuel cutoff operation.

(Fifth mode) As an specific example of the control device according to the fourth mode, in the control device according to a fifth mode of the present invention, the controller may be configured to set the first moment and the second moment that are associated with the current fuel cutoff operation such that the fuel supply cycle which includes the first moment is performed "after" performing the fuel supply cycle which includes the second moment in a case where the fuel supply cycle which includes the first moment was performed "before" performing the fuel supply cycle which includes the second moment in association with the fuel cutoff operation performed "immediately prior to" the current fuel cutoff operation, and to set the first moment and the second moment that are associated with the current fuel cutoff operation such that the fuel supply cycle which includes the first moment is performed "before" performing the fuel supply cycle which includes the second moment in a case where the fuel supply cycle which includes the first moment was performed "after" performing the fuel supply cycle which includes the second moment in association with the fuel cutoff operation performed immediately prior to the current fuel cutoff operation.

According to the configuration described above, the first and second moments that are associated with the current fuel cutoff operation are set in an order reverse to an order of the first and second moments that are associated with the fuel cutoff operation performed immediately prior to the current fuel cutoff operation (in other words, the previous fuel cutoff operation). It is, therefore, considered that the deterioration level of the first catalyst and the deterioration level of the second catalyst are more likely to be kept equal as compared to the case where the first and second moments are set in the same order as the order of the first and second moments associated with the previous fuel cutoff operation.

The foregoing are specific examples of the mode (first mode) in which the timings at which the rich control is started are set taking into account the deterioration levels of the catalysts.

(Sixth mode) The configuration of the internal combustion engine to which the control device according to the present invention is applied is not specifically limited. In other words, the control device according to the present invention can be applied to an internal combustion engine in accordance with the configuration of the internal combustion engine.

For example, in the control device according to a sixth mode of the present invention, in the case where the internal combustion engine includes "a first combustion chamber group" which is a group of a plurality of the combustion chambers which includes the first combustion chamber and "a second combustion chamber group" which is a group of a plurality of the combustion chambers which includes the second combustion chamber and does not include the combustion chambers that belong to the first combustion chamber group, the controller may be configured to start the rich control in the combustion chambers that belong to the first combustion chamber group in the fuel supply cycle which includes the first moment and to start the rich control in the combustion chambers that belong to the second combustion chamber group in the fuel supply cycle which includes the second moment.

Another aspect of the invention relates to a control method for an internal combustion engine which includes a plurality of combustion chambers, and in which a fuel supply cycle in which fuel is sequentially supplied to the plurality of combustion chambers is repeated. The control method includes determining whether a fuel cutoff control condition for performing a fuel cutoff operation is fulfilled during the fuel cutoff operation in which supply of the fuel to the combustion chambers is cut off; if it is determined that the fuel cutoff control condition is unfulfilled during the fuel cutoff operation, setting a first moment at which rich control is started in a first combustion chamber of the plurality of combustion chambers and a second moment at which the rich control is started in a second combustion chamber of the plurality of combustion chambers that is different from the first combustion chamber such that the fuel supply cycle which includes the first moment is different from the fuel supply cycle which includes the second moment; starting the rich control in the first chamber at the first moment to control an amount of the fuel supplied to the first combustion chamber so that an air-fuel ratio of an air-fuel mixture burned in the first combustion chamber is richer than a stoichiometric air-fuel ratio; and starting the rich control in the second chamber at the second moment to control an amount of the fuel supplied to the second chamber so that an air-fuel ratio of an air-fuel mixture burned in the second combustion chamber is richer than the stoichiometric air-fuel ratio.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Description is hereinafter made of control devices according to embodiments (first to fifth embodiments) of the present invention with reference to the drawings.

Figure 1:
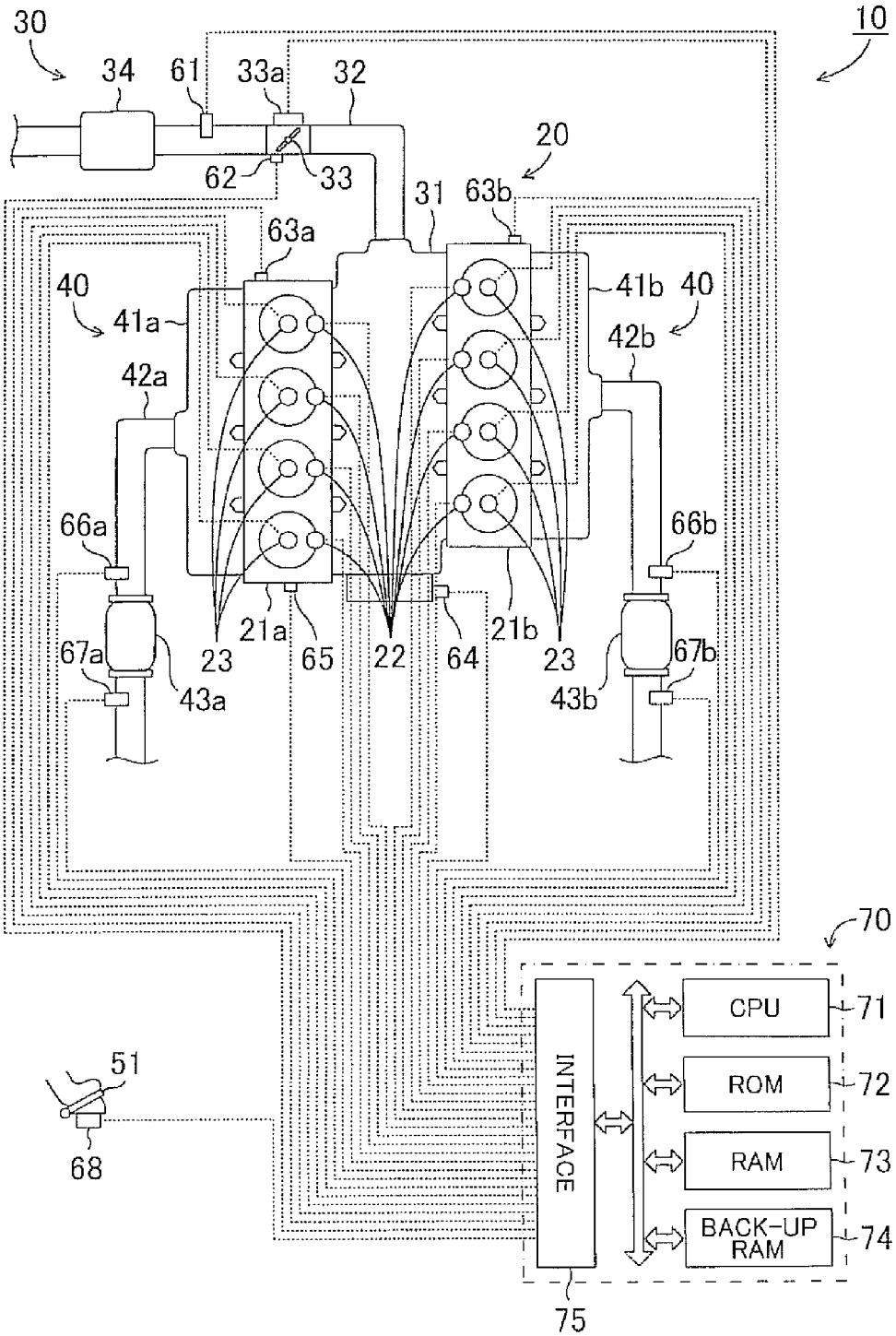
FIG. 1 is a schematic view of an internal combustion engine to which a control device according to a first embodiment of the present invention is applied.

First Embodiment (Outline of Device) FIG. 1 illustrates the schematic configuration of a system in which a control device according to a first embodiment of the present invention (which may also be hereinafter referred to as "first device") is applied to an internal combustion engine 10. The internal combustion engine 10 is a four-cycle spark-ignition multi-cylinder (V8 cylinder) engine. The "internal combustion engine 10" may also be hereinafter referred to simply as "engine 10" for the sake of convenience.

The engine 10 includes an engine main body 20 that includes a fuel injection system, an intake system 30 that introduces a gas produced by mixing air and fuel (air-fuel mixture), into the engine main body 20, an exhaust system 40 that discharges the gas (exhaust gas) discharged from the engine main body 20, to the outside of the engine 10, an accelerator pedal 51, various sensors 61 to 68, and an electronic control device 70.

The engine main body 20 has a first cylinder head 21*a*, a second cylinder head 21*b*, injectors 22, and spark plugs 23. The first cylinder head 21*a* corresponds to four cylinders while the second cylinder head 21*b* corresponds to the other four cylinders. The injectors 22 are connected to a fuel tank (not shown) and is configured to supply fuel into intake ports (not shown) which respectively correspond to the eight cylinders (in other words, into combustion chambers in the cylinders). The spark plugs 23 are provided on top of the eight cylinders.

More specifically, the central axes of a group of cylinders (group of combustion chambers) that belong to the first cylinder head 21*a* and the central axes of a group of cylinders (group of combustion chambers) that belong to the second cylinder head 21*b* are located on two different planes (banks). In addition, the two planes form a V-shape that spreads out from a crankshaft (not shown).

The group of cylinders that belong to the first cylinder head 21*a* may also be hereinafter referred to as "first cylinder group" while the group of cylinders that belong to the second cylinder head 21*b* may also be hereinafter referred to as "second cylinder group" for the sake of convenience.

The intake system 30 includes an intake manifold 31 that is communicated with the cylinders via intake ports (not shown), an intake pipe 32 that is connected to a collecting portion at an upstream end of the intake manifold 31, a throttle valve 33 that can change the opening area (opening cross-sectional area) in the intake pipe 32, a throttle valve actuator 33*a* that rotatably drives the throttle valve 33 according to a command signal from the electronic control device 70, and an air cleaner 34 that is provided upstream of the throttle valve 33 in the intake pipe 32. The intake manifold 31 and the intake pipe 32 constitute intake passages.

The exhaust system 40 is largely dividable into an exhaust system corresponding to the first cylinder head 21*a* and an exhaust system corresponding to the second cylinder head 21*b*. The exhaust system corresponding to the first cylinder head 21*a* includes an exhaust manifold 41*a* that is communicated with respective cylinders via exhaust ports (not shown), an exhaust pipe 42*a* that is connected to a collecting portion at a downstream end of the exhaust manifold 41*a*, and an exhaust gas cleaning catalyst 43*a* that is provided in the exhaust pipe 42*a*. Similarly, the exhaust system corresponding to the second cylinder head 21*b* includes an exhaust manifold 41*b*, and exhaust pipe 42*b*, and an exhaust gas cleaning catalyst 43*b*. The exhaust manifold 41*a* and the exhaust pipe 42*a*, and the exhaust manifold 41*b* and the exhaust pipe 42*b* constitute exhaust passages. Each of the exhaust gas cleaning catalysts (43*a* and 43*b*) may also be hereinafter referred to simply as "catalyst."

Each of the catalysts 43*a* and 43*b* is a three-way catalyst that includes a ceria-zirconia co-catalyst ($CeO_2$—$ZrO_2$) as an oxygen storage substance, a ceramic (such as alumina) as a carrier, and noble metal (for example, platinum and rhodium) as a catalyst component. The catalyst components of the catalysts 43*a* and 43*b* can promote an oxidation-reduction reaction of unburned matters (HC, CO and so on) and nitrogen oxides (NOx) that are contained in the gas to be cleaned, and clean the substances with high conversion efficiency when the catalysts 43*a* and 43*b* have a temperature that is equal to or higher than a specific activation temperature and the gas has an air-fuel ratio close to the stoichiometric air-fuel ratio (the air-fuel ratio of exhaust gas which is generated when an air-fuel mixture with the stoichiometric air-fuel ratio is burned).

In addition, the oxygen storage substance that is contained in the catalysts 43*a* and 43*b* stores excess oxygen when the gas that is introduced into the catalysts 43*a* and 43*b* has an air-fuel ratio which is higher than the stoichiometric air-fuel ratio (in other words, when the gas has a lean air-fuel ratio), and releases the stored oxygen when the gas has an air-fuel ratio which is lower than the stoichiometric air-fuel ratio (in other words, when the gas has a rich air-fuel ratio). Thus, even when the air-fuel ratio of the gas that is introduced into the catalysts 43*a* and 43*b* is not close to the stoichiometric air-fuel ratio, the air-fuel ratio at the catalyst components is adjusted to be equal to the stoichiometric air-fuel ratio and a state in which the gas is cleaned with high conversion efficiency is maintained.

The amount of oxygen that is stored in a catalyst may also be hereinafter referred to as "oxygen storage amount OSA." The maximum amount of oxygen that can be stored in a catalyst may also be hereinafter referred to as "maximum oxygen storage amount Cmax."

The accelerator pedal 51 is provided outside the engine 10. The accelerator pedal 51 is operated by the operator of the engine 10 to input an acceleration request and so on into the engine 10.

As the various sensors 61 to 68, an intake air amount sensor 61, a throttle valve opening sensor 62, cam position sensors 63*a* and 63*b*, a crank position sensor 64, a coolant temperature sensor 65, upstream oxygen concentration sensors 66*a* and 66*b*, downstream oxygen concentration sensors 67*a* and 67*b*, and an accelerator operation amount sensor 68 are provided at designated locations.

The intake air amount sensor 61 is provided in an intake passage (the intake pipe 32). The intake air amount sensor 61 is configured to output a signal proportional to the mass flow rate of the air that is flowing through the intake pipe 32 as the amount of intake air (in other words, the mass of air that is being drawn into the engine 10). Based on this signal, an intake air amount Ga is acquired.

The throttle valve opening sensor 62 is provided in the vicinity of the throttle valve 33. The throttle valve opening sensor 62 is configured to output a signal proportional to the opening of the throttle valve 33. Based on this signal, a throttle valve opening TA is acquired.

The cam position sensor 63*a* is provided in the vicinity of an intake camshaft (not shown) in the first cylinder head 21*a*. The cam position sensor 63*b* is provided in the vicinity of an intake camshaft (not shown) in the second cylinder head 21*b*. Each of the cam position sensors 63*a* and 63*b* is configured to output a signal that has one pulse every time the corresponding intake camshaft rotates by 90° (in other words, every time the crankshaft rotates by 180°). Based on these signals, the rotational positions of the intake camshafts (cam positions) are acquired.

The crank position sensor 64 is provided in the vicinity of the crankshaft (not shown). The crank position sensor 64 is configured to output a signal that has a narrow pulse every time the crankshaft rotates by 10° and output a signal that has a wide pulse every time the crankshaft rotates by 360°. Based on these signals, the number of revolutions per unit time of the crankshaft (which may also be hereinafter referred to as "engine rotational speed NE") is acquired.

The coolant temperature sensor 65 is provided in a passage of coolant in the engine main body 20. The coolant temperature sensor 65 is configured to output a signal proportional to the temperature of coolant. Based on this signal, a coolant temperature THW is measured.

The upstream oxygen concentration sensor 66*a* is provided upstream of the catalyst 43*a* in the exhaust passage (the exhaust pipe 42*a*). Also, the upstream oxygen concentration sensor 66*b* is provided upstream of the catalyst 43*b* in the exhaust passage (the exhaust pipe 42*b*). The upstream oxygen concentration sensors 66*a* and 66*b* are well-known limit current-type oxygen concentration sensors. The upstream oxygen concentration sensors 66*a* and 66*b* are configured to output voltages Vabyfsa and Vabyfsb, respectively, proportional to the air-fuel ratios of the exhaust gases that are introduced into the catalysts 43*a* and 43*b*.

Figure 2:
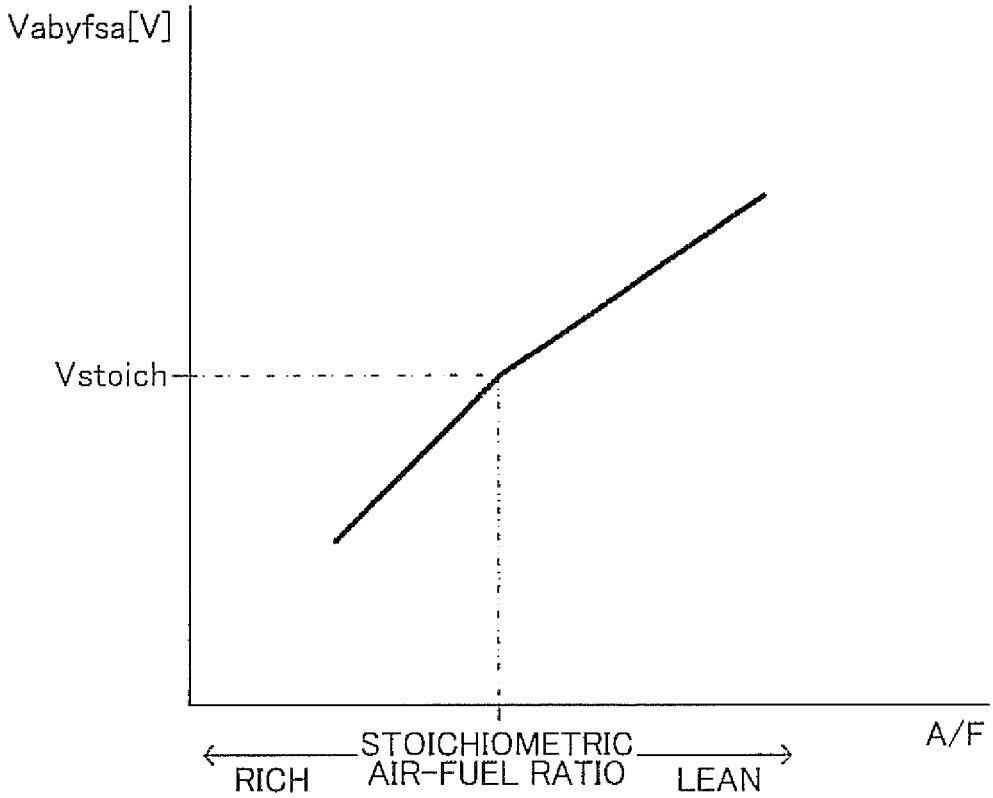
FIG. 2 is a graph that shows the relationship between the output value from an upstream oxygen concentration sensor that is shown in FIG. 1 and the air-fuel ratio of exhaust gas.

The output value Vabyfsa from the upstream oxygen concentration sensor 66*a* is equal to a value Vstoich when the air-fuel ratio of the gas that is introduced into the catalyst 43*a* is equal to stoichiometric air-fuel ratio as shown in FIG. 2. In addition, the output value Vabyfsa increases as the air-fuel ratio of the gas that is introduced into the catalyst 43*a* increases. The relationship between the output value Vabyfsa and the air-fuel ratio A/F that is shown in FIG. 2 may also be hereinafter referred to as "table Mapabyfsa." The relationship between the output value Vabyfsb from the upstream oxygen concentration sensor 66*b* and the air-fuel ratio A/F of the gas that is introduced into the catalyst 43*b* is the same as the above-mentioned relationship that is shown in FIG. 2.

Referring again to FIG. 1, the downstream oxygen concentration sensor 67*a* is provided downstream of the catalyst 43*a* in the exhaust passage (the exhaust pipe 42*a*). The downstream oxygen concentration sensor 67*b* is provided downstream of the catalyst 43*b* in the exhaust passage (the exhaust pipe 42*b*). The downstream oxygen concentration sensors 67*a* and 67*b* are well-known electromotive force-type (concentration cell-type) oxygen concentration sensors. The downstream oxygen concentration sensors 67*a* and 67*b* are configured to output voltages Voxsa and Voxsb, respectively, proportional to the air-fuel ratios of the exhaust gases that are discharged from the catalysts 43*a* and 43*b*.

Figure 3:
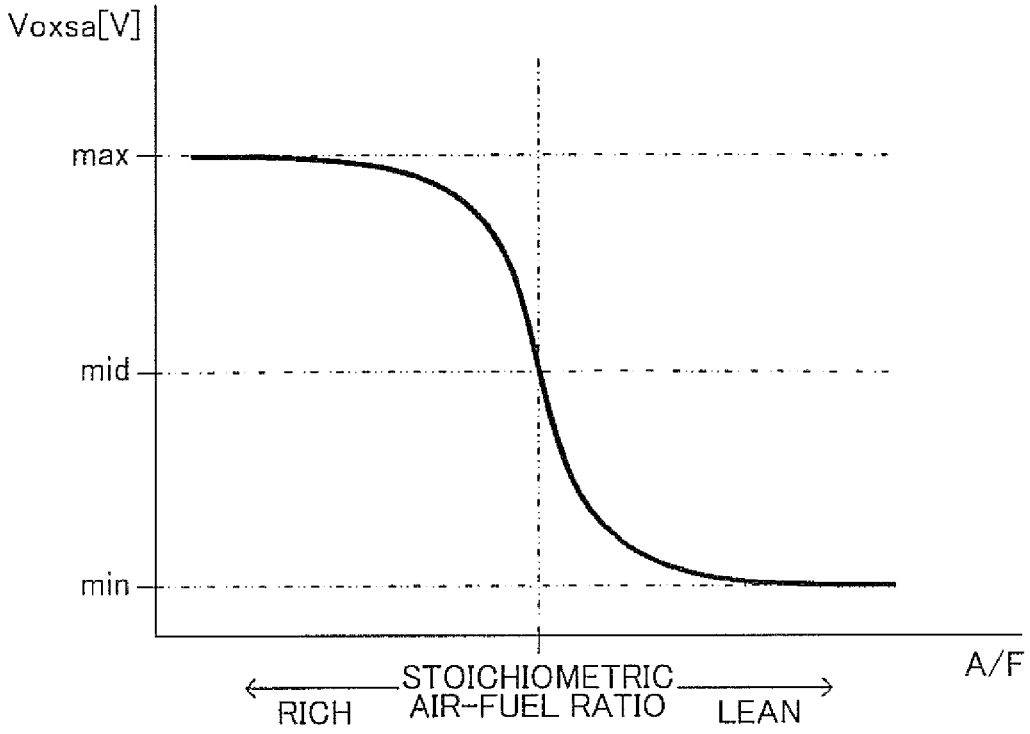
FIG. 3 is a graph that shows the relationship between the output value from a downstream oxygen concentration sensor that is shown in FIG. 1 and the air-fuel ratio of exhaust gas.

The output value Voxsa from the downstream oxygen concentration sensor 67*a* increases as the air-fuel ratio of the gas that is discharged from the catalyst 43*a* is farther away from the stoichiometric air-fuel ratio toward the rich side and decreases as the air-fuel ratio of the gas is farther away from the stoichiometric air-fuel ratio toward the lean side as shown in FIG. 3. The relationship between the output value Voxsb from the downstream oxygen concentration sensor 67*b* and the air-fuel ratio A/F of the gas that is discharged from the catalyst 43*b* is the same as the above-mentioned relationship that is shown in FIG. 3.

The accelerator operation amount sensor 68 is provided in the vicinity of the accelerator pedal 51. The accelerator operation amount sensor 68 is configured to output a signal proportional to the operation amount of the accelerator pedal 51. Based on this signal, an accelerator pedal operation amount Accp is acquired.

The electronic control device 70 includes a CPU 71, a ROM 72 in which programs that are executed by the CPU 71, tables (maps) and constants are preliminarily stored, a RAM 73 in which the CPU 71 temporarily stores data as needed, a backup RAM 74 which stores data while power is on and retains the stored data even while power is off, and an interface 75 which includes an AD converter. The CPU 71, the ROM 72, the RAM 73, the RAM 74 and the interface 75 are connected to each other by a bus.

The interface 75 is connected to the sensors and is configured to transmit the signals from the sensors to the CPU 71. In addition, the interface 75 is connected to the throttle valve actuator 33*a*, the injectors 22, the spark plugs 23 and so on, and is configured to transmit a command signal to them according to a command from the CPU 71.

Figure 4:
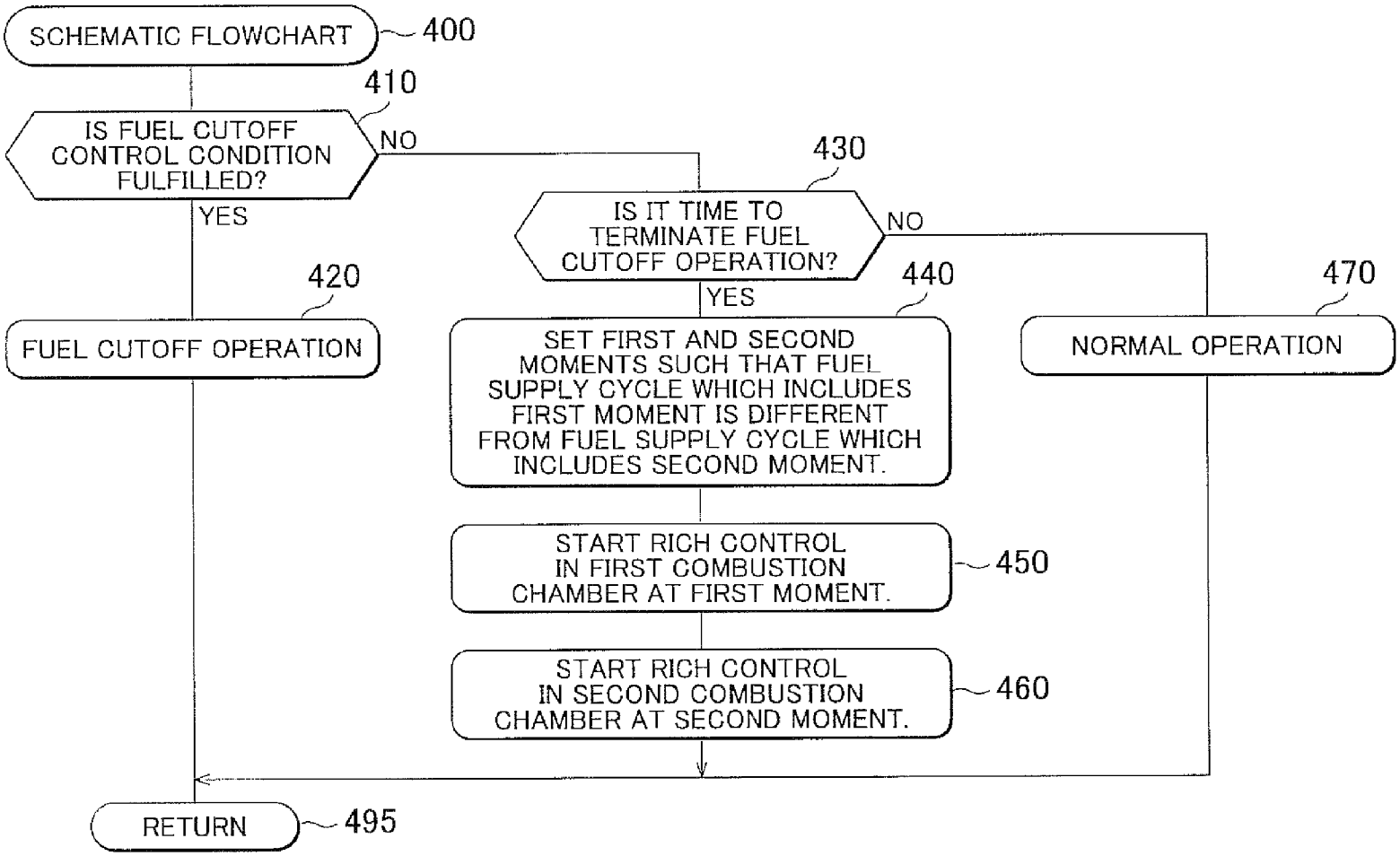
FIG. 4 is a schematic flowchart that shows the operations of the control device according to the first embodiment of the present invention.

(Outline of Operations of Device) The outline of the operations of the first device which is applied to the engine 10 is described below with reference to FIG. 4. FIG. 4 is a "schematic flowchart" that shows the outline of the operations of the first device.

In the engine 10 to which the first device is applied, a "fuel cutoff operation" is performed when a specific condition is fulfilled and "rich control" is performed when a fuel cutoff operation is terminated to restart the supply of fuel to the combustion chambers. The first device sets a first moment at which rich control is started in one of a plurality of combustion chambers (first combustion chamber) and a second moment at which the rich control is started in another combustion chamber (second combustion chamber) such that the fuel supply cycle which includes the first moment is different from the fuel supply cycle which includes the second moment.

Specifically, the first device determines in step 410 in FIG. 4 whether a fuel cutoff control condition (the condition is described in detail later) is fulfilled. When the fuel cutoff control condition is fulfilled, the first device determines "Yes" in step 410 and proceeds to step 420. As a result, the fuel cutoff operation is performed.

The first device continues to determine whether the fuel cutoff control condition is fulfilled during the fuel cutoff operation. When the fuel cutoff control condition becomes unfulfilled during the fuel cutoff operation, the first device determines "No" in step 410. In addition, the first device determines "Yes" in step 430. Then, in step 440, the first device determines the first and second moments such that the fuel supply cycle which includes the first moment is different from the fuel supply cycle which includes the second moment.

Next, the first device proceeds to step 450. As a result, the rich control is started in the first combustion chamber at the first moment. After that, the first device proceeds to step 460. As a result, the rich control is started in the second combustion chamber at the second moment.

When the fuel cutoff operation is not being performed, the first device determines "No" in step 410 and step 430, and proceeds to step 470. As a result, a normal operation (operation in which the air-fuel ratio of the air-fuel mixture is equal to the stoichiometric air-fuel ratio, for example) is performed. The foregoing is the outline of the operations of the first device.

The operation in a period during which the rich control is performed may also be hereinafter referred to as "rich operation" for the sake of convenience.

(Air-Fuel Ratio Control) Next, air-fuel ratio control for performing the fuel cutoff operation, rich operation and normal operation as described above is described.

In the first device, air-fuel ratio control is performed separately in each of "the exhaust system corresponding to the first cylinder head 21*a*" and "the exhaust system corresponding to the second cylinder head 21*b*." However, the air-fuel ratio control in each of the exhaust systems is performed based on the same concept. Thus, the air-fuel ratio control that is performed in the exhaust systems is described below without distinguishing the exhaust systems for the sake of convenience. Specifically, in the following description, the upstream oxygen concentration sensors 66*a* and 66*b* are generically referred to as "upstream oxygen concentration sensor 66" and the downstream oxygen concentration sensors 67*a* and 67*b* are generically referred to as "downstream oxygen concentration sensor 67", for example. The output values from these sensors are generically referred to in the same manner.

The air-fuel ratio control in the first device consists of "main feedback control" that is performed so that an upstream air-fuel ratio abyfs obtained based on the output value Vabyfs from the upstream oxygen concentration sensor 66 is equal to an upstream target air-fuel ratio abyfr, and "sub-feedback control" that is performed so that the output value Voxs from the downstream oxygen concentration sensor 67 is equal to a downstream target output value Voxsref.

More specifically, first, the output value Vabyfs from the upstream oxygen concentration sensor 66 is corrected using a "sub-feedback amount Vafsfb that is calculated so as to decrease an output deviation amount DVoxs, which is the difference between the output value Voxs from the downstream oxygen concentration sensor 67 and the downstream target output value Voxsref." Then, a "feedback control output value Vabyfc" that is obtained as a result of the correction is applied to the table Mapabyfs (refer to FIG. 2) to calculate a "feedback control air-fuel ratio (corrected detected air-fuel ratio) abyfsc." Then, a fuel injection amount Fi is controlled so that the feedback control air-fuel ratio abyfsc is equal to "the upstream target air-fuel ratio abyfr." This air-fuel ratio control is described in more detail below.

It should be noted that, in this air-fuel ratio control, the values of specific parameters at the present moment (moment k) and the values of specific parameters at some moment in the past (moment k-N) are used. In the following, the values of the parameters are the values at the present moment (moment k) unless otherwise specifically noted.

1. Main Feedback Control The main feedback control which is performed by the first device is first described. The first device calculates the feedback control output value Vabyfc according to the equation (1) below. In the equation (1), Vabyfs represents the output value from the upstream oxygen concentration sensor 66, and Vafsfb represents the sub-feedback amount which is calculated based on the output value Voxs from the downstream oxygen concentration sensor 67. The method of calculating the sub-feedback amount Vafsfb is described later.

$$Vabyfc = Vabyfs + Vafsfb \quad (1)$$

Next, the first device applies the feedback control output value Vabyfc to the table Mapabyfs (refer to FIG. 2) to set the feedback control air-fuel ratio abyfsc according to the equation (2) below.

$$abyfsc=\mathrm{Map}abyfs(Vabyfc) \quad (2)$$

Next, the first device calculates a basic fuel injection amount Fbase by dividing an in-cylinder intake air amount Mc(k), which is the amount of air that is being drawn into the cylinder at the present moment (moment k), by an upstream target air-fuel ratio abyfr(k), which is the upstream target air-fuel ratio at the present moment (moment k) according to the equation (3) below. The method of calculating the upstream target air-fuel ratio abyfr(k) is described later.

$$F\mathrm{base}=Mc(k)/abyfr(k) \quad (3)$$

The in-cylinder intake air amount Mc is calculated, every time an intake stroke takes place in each cylinder, based on the intake air amount Ga and the engine rotational speed NE at the moment. For example, the in-cylinder intake air amount Mc is calculated by dividing a value that is obtained by performing primary delay processing on the intake air amount Ga, by the engine rotational speed NE. The in-cylinder intake air amount Mc is stored in the RAM 73 as data associated with each moment (moment k−N, . . . , moment k−1, moment k, moment k+1, . . . ) when an intake stroke takes place. Note that the in-cylinder intake air amount Mc may be calculated using a well-known intake air amount model (a model that is established by simulating the behavior of air in an intake passage).

Next, the first device corrects the basic fuel injection amount Fbase using a main feedback amount DFi (adds the main feedback amount DFi to the basic fuel injection amount Fbase) according to the equation (4) below to calculate a final fuel injection amount Fi. Then, the first device causes the injector 22 for the cylinder in which an intake stroke takes place to inject fuel in an amount equal to the final fuel injection amount Fi. The method of calculating the main feedback amount DFi is described later.

$$Fi=F\mathrm{base}+DFi \quad (4)$$

The main feedback amount DFi in the equation (4) is calculated as described below. First, the first device calculates an "in-cylinder fuel supply amount Fc(k−N)," which is the amount of fuel that was supplied into the combustion chamber at the moment N cycles before the present moment, by dividing the in-cylinder intake air amount Mc(k−N) at the moment N cycles before the present moment (moment k-N) by the feedback control air-fuel ratio (corrected detected air-fuel ratio) abyfsc according to the equation (5) below.

$$Fc(k-N)=Mc(k-N)/abyfsc \quad (5)$$

In the equation (5), the in-cylinder fuel supply amount Fc(k−N) at the moment N cycles before the present moment is calculated by dividing the in-cylinder intake air amount Mc(k−N) at the moment N cycles before the present moment by the feedback control air-fuel ratio abyfsc (at the present moment). This is because it takes time corresponding to N cycles for the air-fuel mixture that is burned in the combustion chamber to reach the upstream oxygen concentration sensor 66.

Next, the first device calculates a "target in-cylinder fuel supply amount Fcr(k−N)" at the moment N cycles before the present moment by dividing the in-cylinder intake air amount Mc(k−N) at the moment N cycles before the present moment by the upstream target air-fuel ratio abyfr(k−N) at the moment N cycles before the present moment according to the equation (6) below.

$$Fcr(k-N)=Mc(k-N)/abyfr(k-N) \quad (6)$$

Next, the first device calculates an "in-cylinder fuel supply amount deviation DFc" by subtracting the in-cylinder fuel supply amount Fc(k−N) from the target in-cylinder fuel supply amount Fcr(k−N) at the moment N cycles before the present moment according to the equation (7) below. The in-cylinder fuel supply amount deviation DFc represents the "excess or deficiency of fuel that was supplied into the cylinder at the moment N cycles before the present moment."

$$DFc=Fcr(k-N)-Fc(k-N) \quad (7)$$

Next, the first device calculates the main feedback amount DFi according to the equation (8) below. In the equation (8), Gp represents a preset proportional gain, Gi represents a preset integral gain, KFB represents a specific coefficient, and SDFc represents a value of integral of the in-cylinder fuel supply amount deviation DFc.

$$DFi=(Gp\cdot DFc+Gi\cdot SDFc)\cdot KFB \quad (8)$$

As shown by the equations (7) and (8) above, the first device uses proportional-integral control based on the feedback control air-fuel ratio abyfsc and the upstream target air-fuel ratio abyfr to calculate the main feedback amount DFi. The main feedback amount DFi is added to the basic fuel injection amount Fbase as indicated by the equation (4). In this way, the final fuel injection amount Fi is calculated. The foregoing is the main feedback control which is performed by the first device.

2. Sub-feedback Control The sub-feedback control which is performed by the first device is next described. The first device calculates the output deviation amount DVoxs by subtracting the current output value Voxs of the downstream oxygen concentration sensor 67 from the downstream target output value Voxsref according to the equation (9) below.

$$DVoxs=Voxs\mathrm{ref}-Voxs \quad (9)$$

Next, the first device calculates the sub-feedback amount Vafsfb according to the equation (10) below. In the equation (10), Kp represent a preset proportional gain (proportional constant), Ki represent a preset integral gain (integral constant), and SDVoxs represent a value of integral of the output deviation amount DVoxs.

$$Vafsfb=Kp\cdot DVoxs+Ki\cdot SDVoxs \quad (10)$$

As shown by the equations (9) and (10) above, the first device uses proportional-integral control based on the output value Voxs from the downstream oxygen concentration sensor 67 and the downstream target output value Voxsref to calculate the sub-feedback amount Vafsfb. The sub-feedback amount Vafsfb is added to the output value Vabyfs from the upstream oxygen concentration sensor 66 as indicated by the equation (1). In this way, the feedback control output value Vabyfc is calculated. The foregoing is the sub-feedback control which is performed by the first device.

3. Summary of Air-Fuel Ratio Control As described above, the first device adds the sub-feedback amount Vafsfb to the output value Vabyfs from the upstream oxygen concentration sensor 66 to correct the output value Vabyfs, and calculates the feedback control air-fuel ratio abyfsc based on the feedback control output value Vabyfc (=Vabyfs+Vafsfb) that is obtained as a result of the correction. Then, the first device calculates the fuel injection amount Fi so that the calculated feedback control air-fuel ratio abyfsc is equal to the upstream target air-fuel ratio abyfr.

As a result, the upstream air-fuel ratio abyfs approaches the upstream target air-fuel ratio abyfr, and the output value Voxs from the downstream oxygen concentration sensor 67 approaches the downstream target output value Voxsref. In other words, both the air-fuel ratios upstream and downstream of the catalyst 43 are caused to approach the respective target values. The foregoing is the air-fuel ratio control that is performed by the first device.

Figure 5:
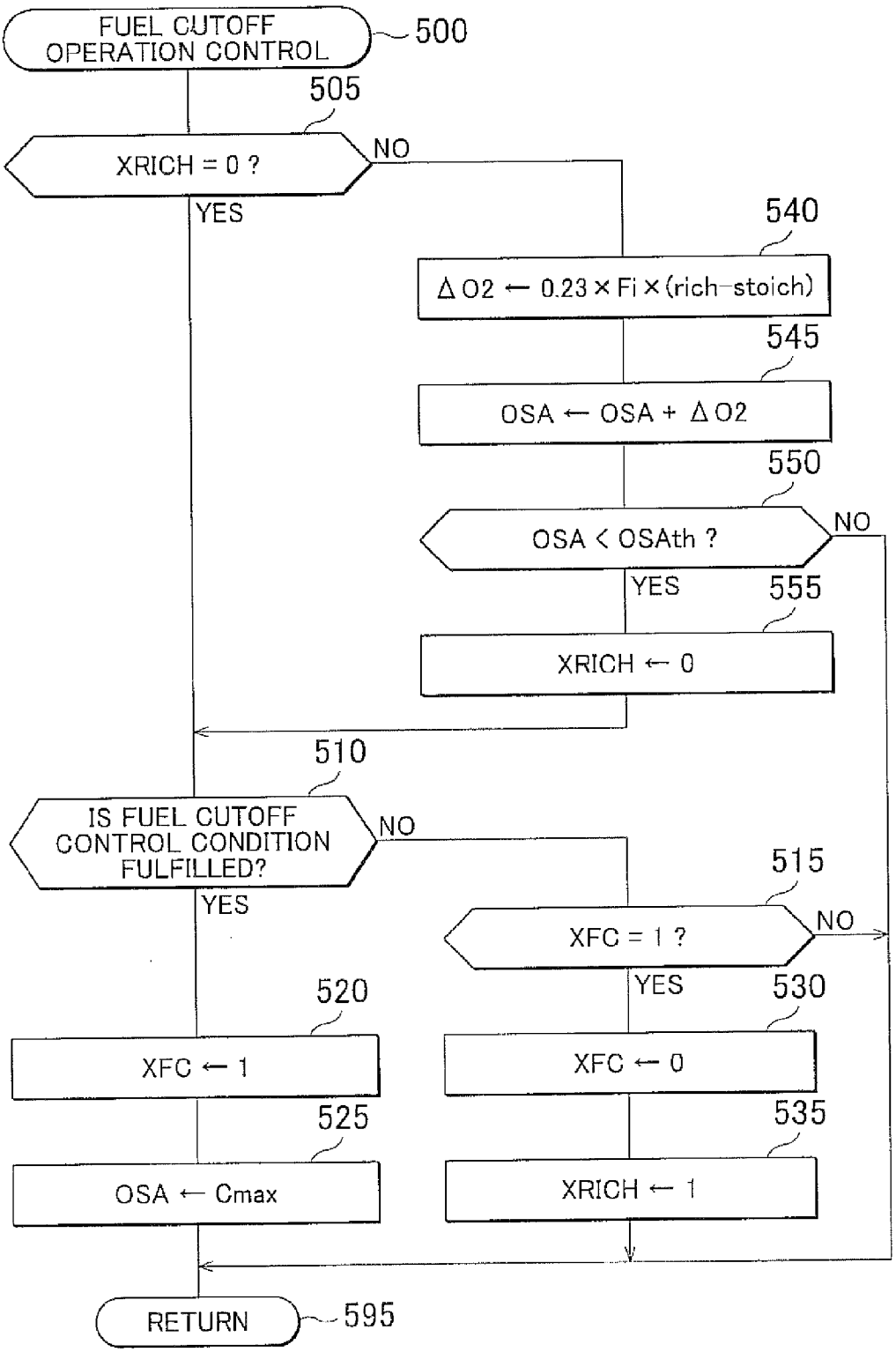
FIG. 5 is a flowchart that shows a routine which is performed by a CPU of the control device according to the first embodiment of the present invention.
Figure 6:
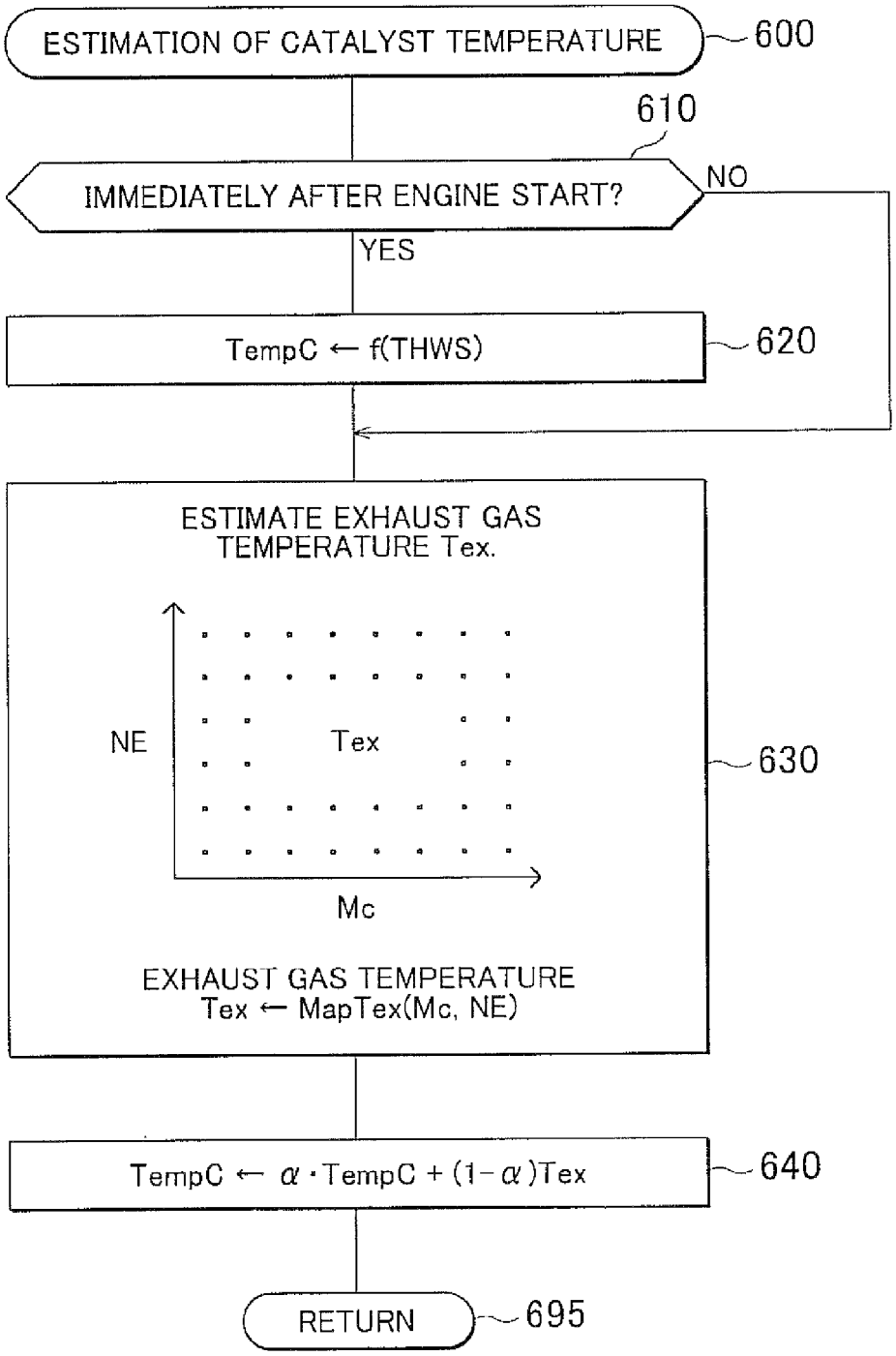
FIG. 6 is a flowchart that shows a routine which is performed by the CPU of the control device according to the first embodiment of the present invention.
Figure 7:
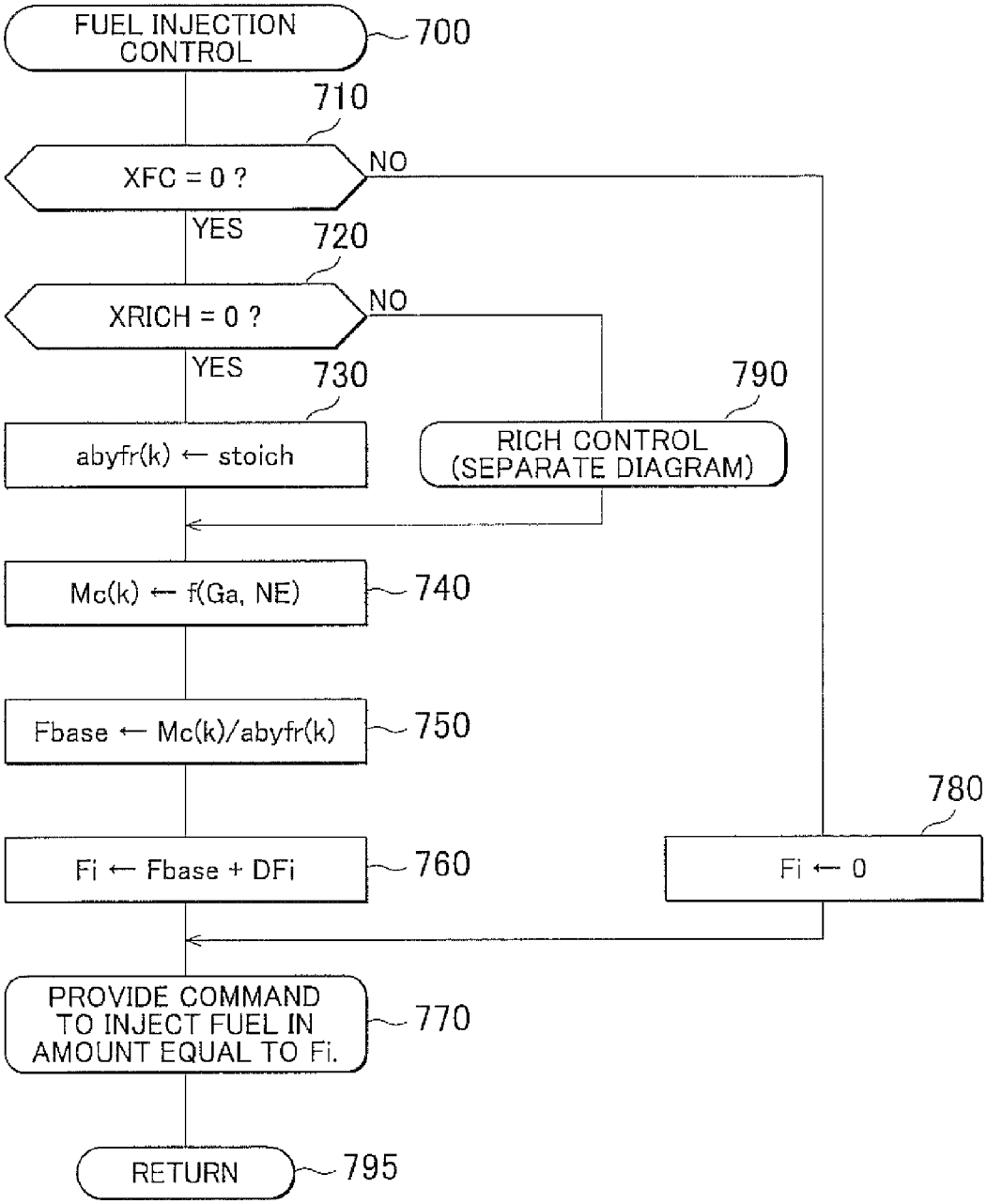
FIG. 7 is a flowchart that shows a routine which is performed by the CPU of the control device according to the first embodiment of the present invention.
Figure 8:
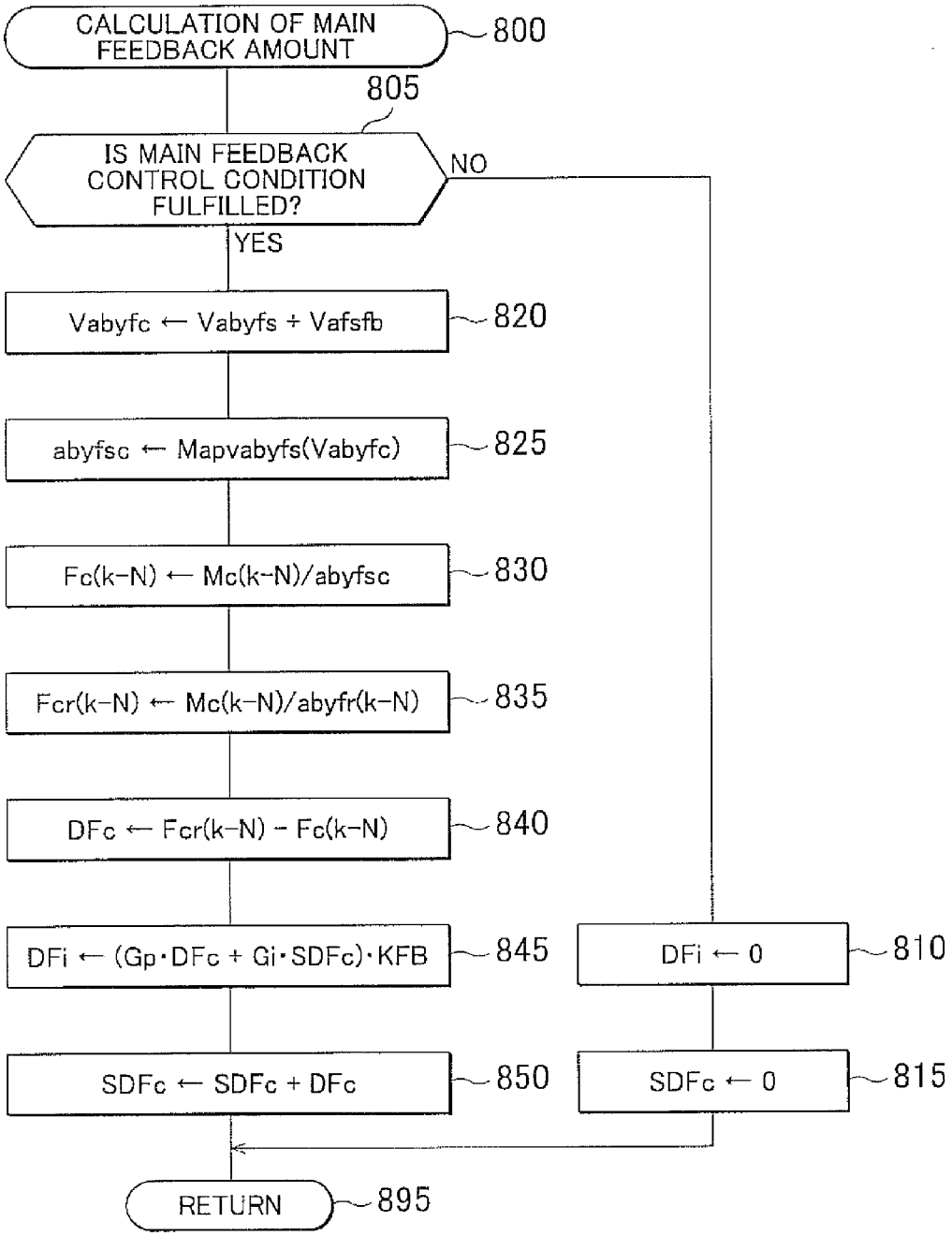
FIG. 8 is a flowchart that shows a routine which is performed by the CPU of the control device according to the first embodiment of the present invention.
Figure 9:
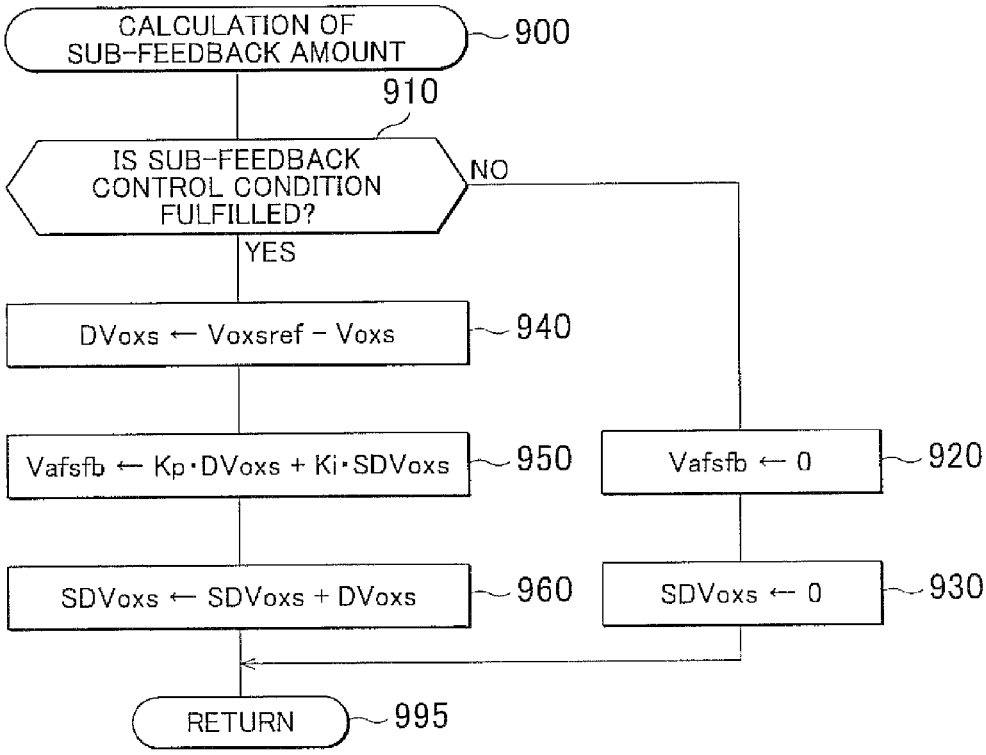
FIG. 9 is a flowchart that shows a routine which is performed by the CPU of the control device according to the first embodiment of the present invention.
Figure 10:
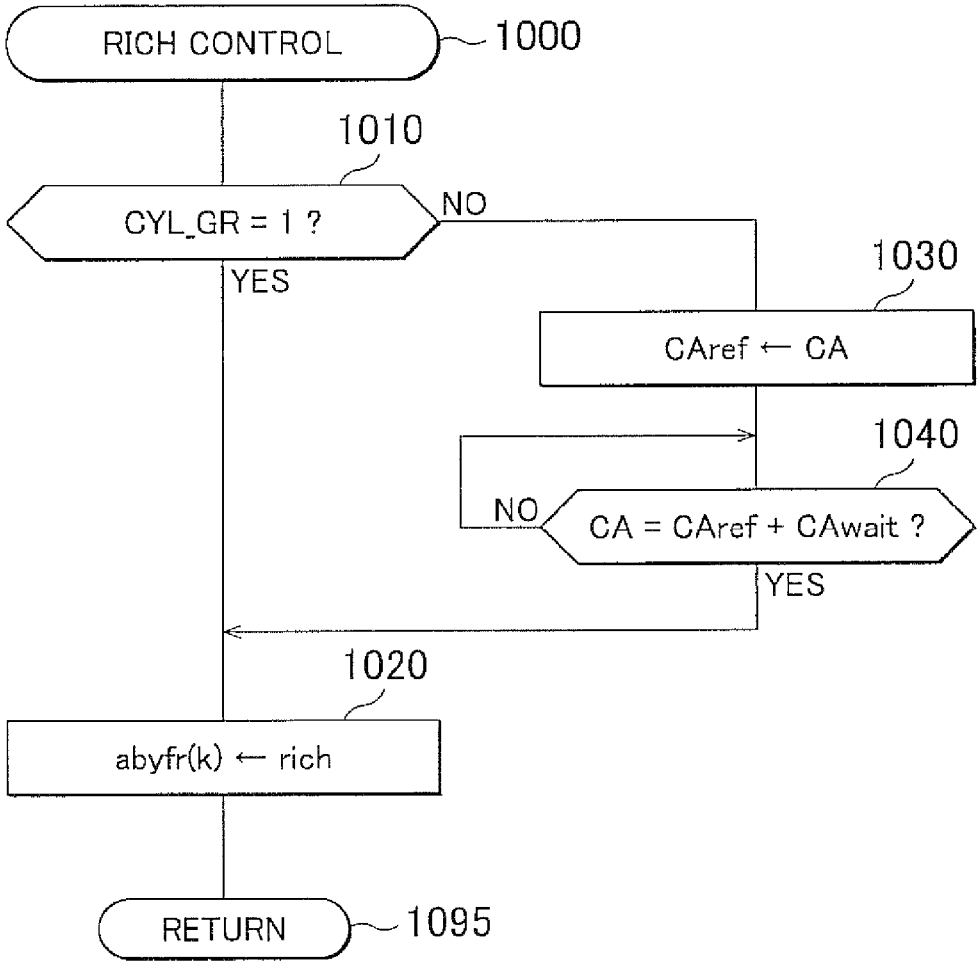
FIG. 10 is a flowchart that shows a routine which is performed by the CPU of the control device according to the first embodiment of the present invention.

(Actual Operation) The actual operations of the first device are described below. In the first device, the CPU 71 performs repeatedly the routine for fuel cutoff operation control that is shown in FIG. 5, the routine for estimation of catalyst temperature that is shown in FIG. 6, the routine for fuel injection control that is shown in FIG. 7, the routine for main feedback control that is shown in FIG. 8, the routine for sub-feedback control that is shown in FIG. 9, and the routine for the rich control that is shown in FIG. 10 at respective specific intervals.

In the first device, each of the above routines is performed independently for each of "the cylinders which are included in the first cylinder group (the group of cylinders that belong to the first cylinder head 21*a*)" and for each of "the cylinders which are included in the second cylinder group (the group of cylinders that belong to the second cylinder head 21*b*)." In the following, however, the routines that are performed for each cylinder are described without distinguishing the cylinders for the sake of convenience unless otherwise specifically noted.

The CPU 71 uses a fuel cutoff operation flag XFC and a rich operation flag XRICH in each of the above routines.

The fuel cutoff operation flag XFC indicates that the engine 10 is in an operating state in which the fuel cutoff operation should not be performed when its value is "0." The fuel cutoff operation flag XFC indicates that the engine 10 is in an operating state in which the fuel cutoff operation should be performed when its value is "1."

The rich operation flag XRICH indicates that the rich operation should not be performed when its value is "0." The rich operation flag XRICH indicates that the rich operation should be performed when its value is "1."

Note that the value of the fuel cutoff operation flag XFC and the value of the rich operation flag XRICH are set to a default value "0" when the engine 10 is started.

In the following, the value of the fuel cutoff operation flag XFC and the value of the rich operation flag XRICH are both assumed to have been set to "0" at the present moment. The assumption may also be hereinafter referred to as "default setting assumption" for the sake of convenience.

The CPU 71 performs the "fuel cutoff operation control routine" that is shown as a flowchart in FIG. 5 repeatedly every time the crank angle of a cylinder becomes equal to a specific crank angle θf before an intake stroke (for example, a crank angle 90° before exhaust top dead center). The CPU 71 uses this routine to determine "whether to perform the fuel cutoff operation" based on the operating state of the engine 10 and to set the values of the fuel cutoff operation flag XFC and the rich operation flag XRICH based on the result of the determination.

The cylinder in which an intake stroke is about to start and whose crank angle is equal to the specific crank angle θf may also be hereinafter referred to as "fuel injection cylinder" for the sake of convenience.

Specifically, the CPU 71 starts processing in step 500 in FIG. 5 at a specific timing and proceeds to step 505. In step 505, the CPU 71 determines whether the value of the rich operation flag XRICH is "0." According to the default setting assumption, the value of the rich operation flag XRICH at the present moment is "0." Thus, the CPU 71 determines "Yes" in step 505 and proceeds to step 510.

In step 510, the CPU 71 determines whether the "fuel cutoff control condition", the condition required for performing the fuel cutoff operation is fulfilled. More specifically, the CPU 71 determines in step 510 that the fuel cutoff control condition is fulfilled when the following conditions (a-1) and (a-2) are both fulfilled. In other words, the CPU 71 determines that the fuel cutoff control condition is not fulfilled when at least one of the following conditions (a-1) and (a-2) is not fulfilled.

(Condition a-1): The accelerator pedal operation amount Accp is zero or the throttle valve opening TA is zero. (Condition a-2): The engine rotational speed NE is equal to or higher than a predetermined threshold value.

The condition (a-1) is used to determine whether the magnitude of torque that the engine 10 is required to produce is sufficiently low. The threshold value for the condition (a-2) is set to a suitable value at which the engine 10 is determined to be able to continue the operation even when the supply of fuel to the engine 10 is cut off. Thus, the fuel cutoff control condition is not fulfilled when an acceleration request is being input into the engine 10, for example.

In the following, the processing operation that is performed in the routine when the fuel cutoff control condition is not fulfilled and the processing operation that is performed in the routine when the fuel cutoff control condition is fulfilled are described separately below.

1. When Fuel Cutoff Control Condition is "Not Fulfilled" In this case, the CPU 71 determines "No" in step 510 and proceeds to step 515. In step 515, the CPU 71 determines whether the value of the fuel cutoff operation flag XFC is "1." According to the default setting assumption, the value of the fuel cutoff operation flag XFC at the present moment is "0." Thus, the CPU 71 determines "No" in step 515. After that, the CPU proceeds to step 595 and terminates the current routine.

In addition, the CPU 71 performs the "catalyst temperature estimation routine" that is shown as a flowchart in FIG. 6 repeatedly at predetermined time intervals. The CPU 71 uses this routine to acquire (estimate) the temperature TempC of the catalyst into which the gas discharged from the fuel injection cylinder is introduced. The temperature TempC of the catalyst is used in the main feedback control routine, which is described later.

Specifically, the CPU 71 starts processing in step 600 in FIG. 6 at a specific timing and proceeds to step 610 to determine whether the engine 10 has been just started at the present moment.

When the engine 10 has been just started at the present moment, the CPU 71 determines "Yes" in step 610 and proceeds to step 620. In step 620, the CPU 71 applies the coolant temperature THWS at the present moment to a start-time catalyst temperature estimating function f(THWS) which is preliminarily defined to express the "relationship between the start-time coolant temperature THWS and the catalyst temperature TempC" to acquire (estimate) the temperature TempC of the catalyst at the present moment.

In the start-time catalyst temperature estimating function f(THWS), the catalyst temperature TempC is defined to increase as the start-time coolant temperature THWS increases.

Next, the CPU 71 proceeds to step 630. In step 630, the CPU 71 applies the in-cylinder intake air amount Mc and the engine rotational speed NE at the present moment to an exhaust gas temperature table MapTex(Mc, NE) which is preliminarily defined to express the "relationship among the in-cylinder intake air amount Mc, the engine rotational speed NE and the exhaust gas temperature Tex" to acquire (estimate) the exhaust gas temperature Tex at the present moment.

Next, the CPU 71 proceeds to step 640. In step 640, the CPU 71 updates and acquires the catalyst temperature TempC according to the equation (11) below. In the equation (11), a represent a constant which is greater than 0 and smaller than 1, TempC(k) represents the catalyst temperature TempC before the update, and TempC(k+1) represents the catalyst temperature TempC after the update.

$$\mathrm{Temp}C(k+1)=\alpha\cdot\mathrm{Temp}C(k)+(1-\alpha)\cdot Tex \quad (11)$$

After performing the processing operation in step 640, the CPU 71 proceeds to step 695 and terminates the current routine.

In contrast, when the present moment is not immediately after the start of the engine 10, the CPU 71 determines "No" in step 610 and proceeds directly to step 630. Thus, after a sufficient time period has passed since the start of the engine 10, the CPU 71 acquires the catalyst temperature TempC without performing the processing operation in step 620.

As described above, the catalyst temperature TempC is acquired (estimated) based on the in-cylinder intake air amount Mc and the engine rotational speed NE. In other words, in the first device, the temperature of the catalyst 43*a*, into which the gas from the cylinders that belong to the first cylinder group is introduced, and the temperature of the catalyst 43*b*, into which the gas from the cylinders that belong to the second cylinder group is introduced, are assumed to be equal to each other.

In addition, the CPU 71 performs the "fuel injection control routine" that is shown as a flowchart in FIG. 7 repeatedly every time the crank angle of the fuel injection cylinder becomes equal to a specific crank angle θg before an intake stroke (for example, a crank angle 60° before exhaust top dead center). The CPU 71 uses this routine to determine the final fuel injection amount Fi and to cause the injector 22 to inject fuel in an amount equal to the final fuel injection amount Fi.

Specifically, the CPU 71 starts processing in step 700 in FIG. 7 at a specific timing and proceeds to step 710 to determine whether the value of the fuel cutoff operation flag XFC is "0." According to the default setting assumption, the value of the fuel cutoff operation flag XFC at the present moment is "0." Thus, the CPU 71 determines "Yes" in step 710 and proceeds to step 720.

In step 720, the CPU 71 determines whether the value of the rich operation flag XRICH is "0." According to the default setting assumption, the value of the rich operation flag XRICH at the present moment is "0." Thus, the CPU 71 determines "Yes" in step 720 and proceeds to step 730.

In step 730, the CPU 71 stores the stoichiometric air-fuel ratio "stoich" in the upstream target air-fuel ratio abyfr(k). Next, the CPU 71 performs the processing operations in step 740 to step 760, after step 730, in this order. The processing operations that are performed in step 740 to step 760 are as follows.

Step 740: The CPU 71 acquires the in-cylinder intake air amount Mc(k), which is the amount of air that is drawn into the fuel injection cylinder, based on the intake air amount Ga and the engine rotational speed NE. Step 750: The CPU 71 calculates the basic fuel injection amount Fbase according to the equation (3) above. Step 760: The CPU 71 calculates the final fuel injection amount Fi by correcting the basic fuel injection amount Fbase using the main feedback amount DFi according to the equation (4) above.

Next, the CPU 71 proceeds to step 770. In step 770, the CPU 71 instructs the injector 22 provided for the fuel injection cylinder to inject fuel in an amount equal to the final fuel injection amount Fi. After that, the CPU proceeds to step 795 and teuninates the current routine.

In this way, the final fuel injection amount Fi is calculated and fuel is injected into the fuel injection cylinder in an amount equal to the final fuel injection amount Fi by the above processing operations. As a result, an operation in which the upstream target air-fuel ratio abyfr is set at the stoichiometric air-fuel ratio "stoich" (normal operation) is performed.

The CPU 71 performs the "main feedback amount calculating routine" that is shown as a flowchart in FIG. 8 at a predetermined moment before the CPU 71 performs the "fuel injection control routine" that is shown in FIG. 7. The CPU 71 uses this routine to calculate the main feedback amount DFi.

Specifically, the CPU 71 starts processing in step 800 in FIG. 8 at a specific timing and proceeds to step 805 to determine whether the "main feedback control condition", the condition required for performing main feedback control is fulfilled. More specifically, the CPU 71 determines in step 805 that the main feedback control condition is fulfilled when the following conditions b-1 to b-5 are all fulfilled. In other words, the CPU 71 determines that the main feedback control condition is not fulfilled when at least one of the following conditions b-1 to b-5 is not fulfilled.

(Condition b-1): The catalyst temperature TempC is equal to or higher than a predetermined threshold value. (Condition b-2): The coolant temperature THW is equal to or higher than a predetermined threshold value. (Condition b-3): The intake air amount Ga is equal to or smaller than a predetermined threshold value. (Condition b-4): The upstream oxygen concentration sensor corresponding to the fuel injection cylinder is activated. (Condition b-5): The fuel cutoff operation is not being performed.

The threshold value for the condition b-1 is set to a suitable value at which the catalyst can be determined to be activated. The threshold value for the condition b-2 is set to a suitable value at which the engine 10 can be determined to have completed the warm-up. The threshold value for the condition b-3 is set to a suitable value at which the load on the engine 10 can be determined to be not excessively high. The condition b-4 is provided because the output value Vabyfs from the upstream oxygen concentration sensor is used in the main feedback control. The condition b-5 is provided because the fuel injection amount cannot be changed during the fuel cutoff operation. Thus, the main feedback control condition is not fulfilled while the engine 10 is being warmed up or when the fuel cutoff operation is being performed, for example.

When the main feedback control condition is "not fulfilled" at the present moment, the CPU 71 determines "No" in step 805 and proceeds to step 810. In step 810, the CPU 71 stores zero in the main feedback amount DFi.

Next, the CPU 71 proceeds to step 815. In step 815, the CPU 71 stores zero in the value SDFc of integral of the in-cylinder fuel supply amount deviation DFc. After that, the CPU 71 proceeds to step 895 and terminates the current routine.

As described above, when the main feedback control condition is not fulfilled, the main feedback amount DFi is set to zero. Thus, in this case, the "correction of the basic fuel injection amount Fbase using the main feedback amount DFi" as described above is not performed (refer to step 760 in FIG. 7).

In addition, the CPU 71 performs the "sub-feedback amount calculating routine" that is shown as a flowchart in FIG. 9 at a predetermined moment before the CPU 71 performs the "main feedback amount calculating routine" that is shown in FIG. 8. The CPU 71 uses this routine to calculate the sub-feedback amount Vafsfb.

Specifically, the CPU 71 starts processing in step 900 in FIG. 9 at a specific timing and proceeds to step 910 to determine whether the "sub-feedback control condition", the condition required for performing sub-feedback control is fulfilled. More specifically, the CPU 71 determines in step 910 that the sub-feedback control condition is fulfilled when the following conditions c-1 to c-3 are all fulfilled. In other words, the CPU 71 determines that the sub-feedback control condition is not fulfilled when at least one of the following conditions c-1 to c-3 is not fulfilled.

(Condition c-1): Main feedback condition is fulfilled. (Condition c-2): The upstream target air-fuel ratio abyfr is set at the stoichiometric air-fuel ratio "stoich". (Condition c-3): The downstream oxygen concentration sensor corresponding to the fuel injection cylinder is activated.

The conditions c-1 and c-2 are provided because the sub-feedback control is performed together with the main feedback control when the normal operation is being performed. The condition c-3 is provided because the output value Voxs from the downstream oxygen concentration sensor is used in the sub-feedback control. Thus, the sub-feedback control condition is not fulfilled while the engine 10 is being warmed up, when the fuel cutoff operation is being performed, or when the rich operation is being performed, for example.

As described above, when the main feedback control condition is not fulfilled at the present moment, the sub-feedback control condition is not fulfilled either (refer to the condition c-1). Thus, in this case, the CPU 71 determines "No" in step 910 and proceeds to step 920. In step 920, the CPU 71 stores zero in the sub-feedback amount Vafsfb.

Next, the CPU 71 proceeds to step 930. In step 930, the CPU 71 stores zero in the value SDVoxs of integral of the output deviation amount DVoxs. After that, the CPU 71 proceeds to step 995 and terminates the current routine.

As described above, when the sub-feedback control condition is not fulfilled, the sub-feedback amount Vafsfb is set to zero. Thus, in this case, the "correction of the output value Vabyfs from the upstream oxygen concentration sensor using the sub-feedback amount Vafsfb," which is described later, is not performed (refer to step 820 in FIG. 8).

As described above, when the main feedback control condition is "not fulfilled" at the present moment, the main feedback amount DFi is set to zero and the sub-feedback amount Vafsfb is set to zero. Thus, fuel is injected into the fuel injection cylinder in an amount equal to the basic fuel injection amount Fbase, which is determined based on the intake air amount Ga, the engine rotational speed NE and the upstream target air-fuel ratio abyfr (which is set to the stoichiometric air-fuel ratio "stoich") (refer to step 730 to step 770 in FIG. 7).

In contrast, when the main feedback control condition is "fulfilled" at the present moment, the CPU 71 determines "Yes" in step 805 in FIG. 8. Next, the CPU 71 performs the processing operations in step 820 to step 850, after step 805, in this order. The processing operations that are performed in step 820 to step 850 are as follows.

Step 820: The CPU 71 calculates the feedback control output value Vabyfc according to the equation (1) above. The sub-feedback amount Vafsfb at the present moment is zero as described above. Step 825: The CPU 71 determines the feedback control air-fuel ratio abyfsc according to the equation (2) above. Step 830: The CPU 71 calculates the in-cylinder fuel supply amount Fc(k-N) at the moment N cycles before the present moment according to the equation (5) above. Step 835: The CPU 71 calculates the target in-cylinder fuel supply amount Fcr(k-N) at the moment N cycles before the present moment according to the equation (6) above. Step 840: The CPU 71 calculates the in-cylinder fuel supply amount deviation DFc according to the equation (7) above. Step 845: The CPU 71 calculates the main feedback amount DFi according to the equation (8) above. In the first device, "1" is adopted as the coefficient KFB. The value SDFc of integral of the in-cylinder fuel supply amount deviation DFc is a value that is obtained by adding up the values of the in-cylinder fuel supply amount deviation DFc up to the present moment (refer to step 850 below). Step 850: The CPU 71 calculates (updates) a new value SDFc of integral of the in-cylinder fuel supply amount deviation by adding the in-cylinder fuel supply amount deviation DFc acquired in step 840 to the value SDFc of integral of the in-cylinder fuel supply amount deviation DFc at the present moment.

After performing the processing operation in step 850, the CPU 71 proceeds to step 895 and terminates the current routine. In this way, proportional-integral control is used to calculate the main feedback amount DFi (refer to step 845). Then, the final fuel injection amount Fi is calculated by using the main feedback amount DFi (refer to step 760 in FIG. 7).

In addition, when the sub-feedback control condition is not fulfilled, the CPU 71 determines "No" in step 910 in FIG. 9. Then, the CPU 71 proceeds to step 995 via step 920 and step 930 and terminates the current routine. As described above, the sub-feedback amount Vafsfb is not calculated in this case.

In contrast, when the sub-feedback control condition is fulfilled, the CPU 71 determines "Yes" in step 910. Next, the CPU 71 performs the processing operations in step 940 to step 960, after step 910, in this order. The processing operations that are performed in step 940 to step 960 are as follows.

Step 940: The CPU 71 calculates the output deviation amount DVoxs according to the equation (9) above. In the first device, a value corresponding to an air-fuel ratio which is slightly richer than the stoichiometric air-fuel ratio is adopted as the downstream target output value Voxsref in view of the exhaust gas cleaning performance of the catalyst 43. Step 950: The CPU 71 calculates the sub-feedback amount Vafsfb according to the equation (10) above. In the first device, predetermined suitable values are adopted as the proportional gain Kp and the integral gain Ki. Step 960: The CPU 71 calculates (updates) a new value SDVoxs of integral of the output deviation amount by adding the output deviation amount DVoxs acquired in step 940 to the value SDVoxs of integral of the output deviation amount at the present moment.

After performing the processing operation in step 960, the CPU 71 proceeds to step 995 and terminates the current routine. In this way, proportional-integral control is used to calculate the sub-feedback amount Vafsfb (refer to step 950). Then, the output value Vabyfs from the upstream oxygen concentration sensor is corrected by using the sub-feedback amount Vafsfb (refer to step 820 in FIG. 8). In addition, the main feedback amount DFi is calculated based on the corrected feedback control output value Vabyfc (refer to step 845 in FIG. 8), and the final fuel injection amount Fi is corrected by using the main feedback amount DFi (refer to step 760 in FIG. 7). The foregoing is the processing operation that is performed in each routine when the fuel cutoff control condition is "not fulfilled".

2. When Fuel Cutoff Control Condition is "Fulfilled" In this case, the CPU 71 proceeds to step 510 via step 505 in FIG. 5, and the CPU 71 determines "Yes" in step 510 and proceeds to step 520. In step 520, the CPU 71 stores "1" in the value of the fuel cutoff operation flag XFC.

Next, the CPU 71 proceeds to step 525. In step 525, the CPU 71 stores the maximum oxygen storage amount Cmax in the oxygen storage amount OSA of the catalyst. This is because it is considered that a large amount of air (gas with a lean air-fuel ratio) is introduced into the catalyst and the oxygen storage amount OSA of the catalyst reaches the maximum oxygen storage amount Cmax during the fuel cutoff operation. After that, the CPU proceeds to step 595 and terminates the current routine.

In addition, when the CPU 71 proceeds to step 710 in FIG. 7, the CPU 71 determines "No" in step 710 because the value of the fuel cutoff operation flag XFC at the present moment is "1," and proceeds to step 780. In step 780, the CPU 71 stores zero in the final fuel injection amount Fi.

Next, the CPU 71 proceeds to step 770. Because the final fuel injection amount Fi at the present moment is zero, no fuel is injected. After that, the CPU proceeds to step 795 and terminates the current routine.

As described above, when the fuel cutoff control condition is fulfilled, the final fuel injection amount Fi is set to zero. As a result, an operation in which fuel supply to the fuel injection cylinder is cut off (i.e., fuel cutoff operation) is performed.

It should be noted that, in this case, because the main feedback control condition and the sub-feedback control condition are not fulfilled (refer to condition b-5 and condition c-1 above), the correction of the basic fuel injection amount Fbase using the main feedback amount DFi and the correction of the output value Vabyfs from the upstream oxygen concentration sensor using the sub-feedback amount Vafsfb are not performed. The foregoing is the processing that is performed in each routine when the fuel cutoff control condition is "fulfilled".

As described above, once the fuel cutoff operation is started, the fuel cutoff operation is continued as long as the fuel cutoff control condition is fulfilled. Then, when the fuel cutoff control condition becomes unfulfilled during the fuel cutoff operation, the fuel cutoff operation is terminated. The "rich control" that is performed after the fuel cutoff operation is terminated is described below.

Specifically, the CPU 71 repeats the processing operations in step 505, step 510, step 520 and step 525 in FIG. 5 as long as the fuel cutoff control condition is fulfilled. In this way, the fuel cutoff operation is continued. Then, when the fuel cutoff control condition becomes unfulfilled during the fuel cutoff operation, the CPU 71 determines "No" in step 510 and proceeds to step 515.

Because the fuel cutoff operation flag XFC at the present moment is still "1," the CPU 71 determines "Yes" in step 515 and proceeds to step 530. In step 530, the CPU 71 stores "0" in the value of the fuel cutoff operation flag XFC.

Next, the CPU 71 proceeds to step 535. In step 535, the CPU 71 stores "1" in the value of the rich operation flag XRICH. After that, the CPU 71 proceeds to step 595 and terminates the current routine.

In addition, when the CPU 71 proceeds to step 710 in FIG. 7, the CPU 71 determines "Yes" in step 710 because the value of the fuel cutoff operation flag XFC at the present moment is "0," and proceeds to step 720. Because the value of the rich operation flag XRICH at the present moment is "1," the CPU 71 determines "No" in step 720 and proceeds to step 790.

In step 790, the CPU 71 performs the "routine that is shown in FIG. 10." The CPU 71 uses the routine that is shown in FIG. 10 to adjust a timing of starting the rich control (first or second moment) depending on the fuel injection cylinder (depending on whether the fuel injection cylinder belongs to the first cylinder group or the second cylinder group).

Here, "1" is assigned as a cylinder group number CYL_GR to the cylinders that belong to the first cylinder group, and "2" is assigned as a cylinder group number CYL_GR to the cylinders that belong to the second cylinder group. The CPU 71 checks the cylinder group number CYL_GR to determine whether the fuel injection cylinder belongs to the first cylinder group or the second cylinder group.

Specifically, the CPU 71 starts processing in step 1000 in FIG. 10 and proceeds to step 1010. In step 1010, the CPU 71 determines whether the cylinder group number CYL_GR that is assigned to the fuel injection cylinder is "1" (in other words, whether the fuel injection cylinder belongs to the first cylinder group).

When the cylinder group number CYL_GR of the fuel injection cylinder at the present moment is "1," the CPU 71 determines "Yes" in step 1010 and proceeds to step 1020. In step 1020, the CPU 71 stores a rich air-fuel ratio "rich" in the upstream target air-fuel ratio abyfr(k). After that, the CPU proceeds to step 1095 and terminates the current routine. Then, the CPU 71 returns to the routine in FIG. 7.

When the CPU 71 returns to the routine in FIG. 7, the CPU 71 performs the processing operations in step 740 through step 770 after step 790. Specifically, the basic fuel injection amount Fbase is calculated so that the air-fuel ratio of the air-fuel mixture is equal to the upstream target air-fuel ratio (which has been set to the rich air-fuel ratio "rich") (step 750), and the basic fuel injection amount Fbase is corrected using the main feedback amount DFi to calculate the final fuel injection amount Fi (step 760). Then, fuel is supplied into the fuel injection cylinder in an amount equal to the final fuel injection amount Fi (step 770).

As described above, when the cylinder group number CYL_GR of the fuel injection cylinder is "1" (when the fuel injection cylinder belongs to the first cylinder group), the upstream target air-fuel ratio abyfr(k) is "immediately" set to the rich air-fuel ratio "rich" in the routine that is shown in FIG. 10 (step 1010 and step 1020 in FIG. 10). As a result, an operation in which the upstream target air-fuel ratio abyfr is set to the rich air-fuel ratio "rich" (rich operation) is performed "immediately" after the fuel cutoff operation is terminated.

In contrast, when the cylinder group number CYLGR of the fuel injection cylinder at the present moment is not "1" (in other words, when the cylinder group number CYL_GR is "2"), the CPU 71 determines "No" in step 1010 and proceeds to step 1030. In step 1030, the CPU 71 stores the crank angle CA at the present moment in a reference crank angle CAref.

Next, the CPU 71 proceeds to step 1040. In step 1040, the CPU 71 determines whether the crank angle CA at the present moment is equal to the "sum of the reference crank angle CAref and a waiting crank angle CAwait." The waiting crank angle CAwait has been set to a suitable value so that the fuel supply cycle which includes the moment at which the rich control is started in a cylinder that belongs to the first cylinder group (i.e., first moment) is different from the fuel supply cycle which includes the moment at which the rich control is started in a cylinder that belongs to the second cylinder group (i.e., second moment).

Because the crank angle CA at the present moment is equal to the reference crank angle CAref (refer to step 1030), the CPU 71 determines "No" in step 1040. After that, the CPU 71 repeats the processing operation in step 1040 until the crank angle CA becomes equal to the "sum of the reference crank angle CAref and the waiting crank angle CAwait." In other words, the CPU 71 waits until the crank angle CA changes by the amount equal to the waiting crank angle CAwait after the crank angle CA at the present moment is stored in the reference crank angle CAref (substantially, after the routine that is shown in FIG. 10 is started) in step 1040.

After that, when the crank angle CA at the present moment reaches the "sum of the reference crank angle CAref and the waiting crank angle CAwait," the CPU 71 determines "Yes" in step 1040 and proceeds to step 1020. In step 1020, the CPU 71 stores the rich air-fuel ratio "rich" in the upstream target air-fuel ratio abyfr(k). After that, fuel is supplied into the fuel injection cylinder in an amount equal to the final fuel injection amount Fi so that the air-fuel ratio of the air-fuel mixture becomes equal to the upstream target air-fuel ratio abyfr (rich air-fuel ratio "rich") in the routine that is shown in FIG. 7 (step 770).

As described above, when the cylinder group number CYL_GR of the fuel injection cylinder is "2" (when the fuel injection cylinder belongs to the second cylinder group), the upstream target air-fuel ratio abyfr(k) is set to the rich air-fuel ratio "rich" "after a wait of a period corresponding to the waiting crank angle CAwait" (step 1030, step 1040 and step 1020 in FIG. 10) in the routine that is shown in FIG. 10. As a result, the rich operation is performed after the fuel cutoff operation such that "rich control is started in a fuel supply cycle that is different from the fuel supply cycle which includes the first moment at which the rich control is started in a cylinder that belongs to the first cylinder group." In other words, the moments when the rich control is started (first and second moments) are set such that the fuel supply cycle which includes the moment at which the rich control is started in a cylinder that belongs to the first cylinder group is different from the fuel supply cycle which includes the moment at which the rich control is started in a cylinder that belongs to the second cylinder group.

As described above, once the rich operation is started, the rich operation is continued as long as the rich operation flag XRICH is "1." Then, when the rich operation flag XRICH is set to "0" during the rich operation, the rich operation is terminated.

Specifically, when the CPU 71 proceeds to step 505 in FIG. 5 during the rich operation, the CPU 71 determines "No" in step 505 because the value of the rich operation flag XRICH at the present moment is "1."

The CPU 71 calculates the oxygen storage amount OSA of the catalyst in step 540 and step 545 after step 505. In other words, the CPU 71 calculates a change $\Delta O_2$ in the oxygen storage amount OSA of the catalyst according to the equation (12) below in step 540. In the equation (12), the value 0.23 represents the oxygen concentration (weight percent concentration) in air in the standard state, Fi represents the final fuel injection amount Fi at a moment immediately before the present moment, "rich" represents the rich air-fuel ratio, and the "stoich" represents the stoichiometric air-fuel ratio. As is well known, the standard state means the state at a temperature of 0° C. (273.15 K) and a pressure of 1 bar ($10^5$ Pa).

$$\Delta O_2 = 0.23 \times Fi \times (\text{rich} - \text{stoich}) \quad (12)$$

As is evident from the right hand side of the equation (12), a "value $\Delta O_2$ which expresses the amount of oxygen that is contained in the exhaust gas that is introduced into the catalyst per unit time with respect to the amount of oxygen that is contained in exhaust gas with the stoichiometric air-fuel ratio" is calculated by the equation (12). Because the value of the rich air-fuel ratio "rich" is smaller than the value of the stoichiometric air-fuel ratio "stoich", $\Delta O_2$ is a negative value.

More briefly, $\Delta O_2$ is a value that represents the "deficit of oxygen with respect to the amount of oxygen that is contained in exhaust gas with the stoichiometric air-fuel ratio." In other words, $\Delta O_2$ (negative value) indicates the amount of oxygen that is "released" from the catalyst per unit time.

Next, the CPU 71 calculates the oxygen storage amount OSA of the catalyst according to the equation (13) below in step 545. When step 545 is performed for the first time, the oxygen storage amount OSA of the catalyst is equal to the maximum oxygen storage amount Cmax (refer to step 525).

$$OSA = OSA + \Delta O_2 \quad (13)$$

As described above, $\Delta O_2$ is a negative value. Thus, the oxygen storage amount is calculated by subtracting the absolute value of $\Delta O_2$ from the maximum oxygen storage amount Cmax according to the equation (13) as a new oxygen storage amount OSA (that is, the oxygen storage amount OSA is updated).

Next, the CPU 71 proceeds to step 550. In step 550, the CPU 71 determines whether the oxygen storage amount OSA of the catalyst is smaller than a predetermined threshold value OSAth. The threshold value OSAth has been set to a suitable value (for example, a value equal to a half of the maximum oxygen storage amount Cmax) in view of the exhaust gas cleaning performance of the catalyst.

When the oxygen storage amount OSA at the present moment is "equal to or greater than the threshold value OSAth," the CPU 71 determines "No" in step 550 and proceeds to step 595 to terminate the current routine. In this case, the value of the rich operation flag XRICH is maintained at "1." Then, the routines in FIG. 7 to FIG. 10 are performed to continue the rich operation.

In contrast, when the oxygen storage amount OSA at the present moment is "smaller than the threshold value OSAth," the CPU 71 determines "Yes" in step 550 and proceeds to step 555. In step 555, the CPU 71 stores "0" in the value of the rich operation flag XRICH.

Next, the CPU 71 proceeds to step 510. When the fuel cutoff control condition is not fulfilled at the present moment (the fuel cutoff control condition is, in general, not fulfilled because the rich control is in progress), the CPU 71 determines "No" in step 510 and proceeds to step 515. In addition, because the value of the fuel cutoff operation flag XFC at the present moment is "0," the CPU 71 determines "No" in step 515. After that, the CPU proceeds to step 595 and terminates the current routine.

Next, when the CPU 71 starts processing in step 700 in FIG. 7, the CPU 71 determines "Yes" in step 710 and in step 720 because the values of the fuel cutoff operation flag XFC and the rich operation flag XRICH at the present moment are "0" and proceeds to step 730. In step 730, the CPU 71 stores the stoichiometric air-fuel ratio "stoich" in the upstream target air-fuel ratio abyfr(k). After that, the processing operations in step 740 through step 770 are performed to restart the normal operation.

As described above, the rich operation is continued until the oxygen storage amount OSA of the catalyst becomes smaller than the predetermined threshold value OSAth. Then, when the oxygen storage amount OSA of the catalyst becomes smaller than the threshold value OSAth, the normal operation is restarted.

As described above, the first device performs "rich control" when the fuel cutoff operation is terminated and the supply of fuel to the combustion chambers is restarted. The first device sets the moment at which the rich control is started in a cylinder that belongs to the first cylinder group (i.e., first moment) and the moment at which the rich control is started in a cylinder that belongs to the second cylinder group (i.e., second moment) such that the moments (i.e., first and second moments) are included in different fuel supply cycles. The foregoing is the description of the first device.

Second Embodiment

As one specific example of the first device (in which the first and second moments are set such that the fuel supply cycle which includes the first moment is different from the fuel supply cycle which includes the second moment), an embodiment in which "the moments at which the rich control is started are set based on the deterioration levels of the catalysts" is next described.

A control device according to this embodiment (which may also be referred to as "second device") is applied to an engine which has a configuration similar to that of the engine 10 (refer to FIG. 1) to which the first device is applied (the engine to which the second device is applied may also be hereinafter referred to as "the engine 10" for the sake of convenience).

Figure 11:
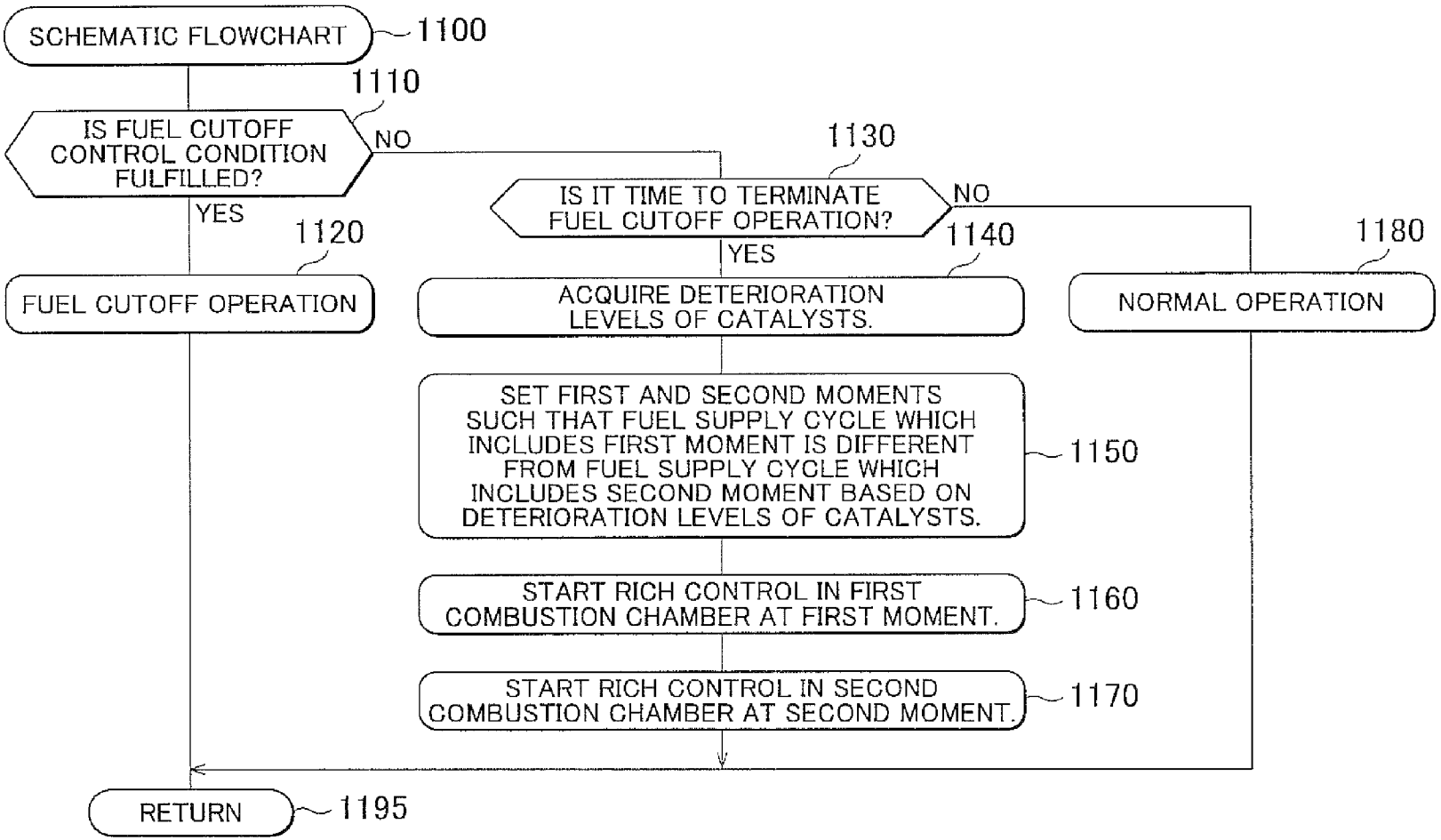
FIG. 11 is a flowchart that shows a routine which is performed by the CPU of a control device according to a second embodiment of the present invention.

(Outline of Operations of Device) The outline of the operations of the second device which is applied to the engine 10 is described below with reference to FIG. 11. FIG. 11 is a "schematic flowchart" that shows the outline of the operations of the second device.

In the engine 10 to which the second device is applied, the "fuel cutoff operation" is performed when the specific condition is fulfilled and the "rich control" is performed when the fuel cutoff operation is terminated and the supply of fuel to the combustion chambers is restarted. The second device sets the first moment at which the rich control is started in one of the combustion chambers (first combustion chamber) and the second moment at which the rich control is started in another combustion chamber (second combustion chamber) based on the deterioration levels of the catalysts 43*a* and 43*b* such that the fuel supply cycle which includes the first moment is different from the fuel supply cycle which includes the second moment.

Specifically, the second device determines in step 1110 in FIG. 11 whether the fuel cutoff control condition (the same condition as that in the first device) is fulfilled. When the fuel cutoff control condition is fulfilled, the second device determines "Yes" in step 1110 and proceeds to step 1120. As a result, the fuel cutoff operation is performed.

The second device continues to determine whether the fuel cutoff control condition is fulfilled during the fuel cutoff operation. When the fuel cutoff control condition becomes unfulfilled during the fuel cutoff operation, the second device determines "No" in step 1110. In addition, the second device determines "Yes" in step 1130.

Next, the second device proceeds to step 1140, and acquires the deterioration levels of the catalysts 43*a* and 43*b* (the method of acquiring the deterioration levels is described later). Then, in step 1150, the second device sets the first and second moments based on the deterioration levels of the catalysts 43*a* and 43*b* such that the fuel supply cycle which includes the first moment is different from the fuel supply cycle which includes the second moment.

Next, the second device proceeds to step 1160. As a result, the rich control is started in the first combustion chamber at the first moment. After that, the second device proceeds to step 1170. As a result, the rich control is started in the second combustion chamber at the second moment.

When the fuel cutoff operation is not being performed, the second device determines "No" in step 1110 and step 1130, and proceeds to step 1180. As a result, the normal operation (operation in which the air-fuel ratio of the air-fuel mixture is equal to the stoichiometric air-fuel ratio, for example) is performed.

As described above, the second device sets the moment at which the rich control is started in a cylinder that belongs to the first cylinder group (i.e., first moment) and the moment at which the rich control is started in a cylinder that belongs to the second cylinder group (i.e., second moment) based on the deterioration levels of the catalysts 43*a* and 43*b*.

The exhaust gas cleaning performance of a catalyst may be deteriorated for various reasons. In the case where the internal combustion engine is provided with a plurality of catalysts, it is desirable that the degrees of deterioration of the catalysts should be as equal as possible from the viewpoint of reducing emissions. Thus, when the first and second moment are set based on the deterioration levels of the catalysts 43*a* and 43*b* as described above, the deterioration levels of the catalysts 43*a* and 43*b* can be kept as equal as possible and emissions can be reduced.

As a specific method of setting the first and second moments based on the deterioration levels of the catalysts 43*a* and 43*b*, various methods may be adopted taking into account the configuration of the internal combustion engine and properties of the catalyst. Thus, some specific examples of actual operations of the second device are described as embodiments below. The foregoing is the description of the second device.

Third Embodiment

An embodiment in which "the moments at which the rich control is started are set taking into account the deterioration levels of the catalysts and the temperatures of the catalysts" is next described as one specific example of the second device.

A control device according to this embodiment (which may also be referred to as "third device") is applied to an engine which has a configuration similar to that of the engine 10 (refer to FIG. 1) to which the first device is applied (the engine to which the third device is applied may also be hereinafter referred to as "the engine 10" for the sake of convenience).

(Method of Acquiring Deterioration Levels of Catalysts) The method of acquiring the deterioration levels of the catalysts is described below. In the third device, the "deterioration level Dcata of the catalyst 43*a*" and the "deterioration level Death of the catalyst 43*b*" are acquired separately. However, the deterioration levels of these catalysts are acquired separately based on the same concept. Thus, the method for acquiring the deterioration level of a catalyst is described below without distinguishing the catalysts for the sake of convenience. Specifically, in the following description, the catalysts 43*a* and 43*b* are generically referred to as "catalyst 43" and the deterioration levels Dcata and Dcatb are generically referred to as "deterioration level Dcat," for example.

1. Acquisition of Maximum Oxygen Storage Amount The third device performs control operations to acquire the deterioration level Dcat of the catalyst 43 (which may also be hereinafter referred to as "catalyst deterioration level acquiring control") when "catalyst deterioration level acquiring condition," which is described later, is fulfilled. The catalyst deterioration level acquiring control is described with reference to the time chart that is shown in FIG. 12.

Figure 12:
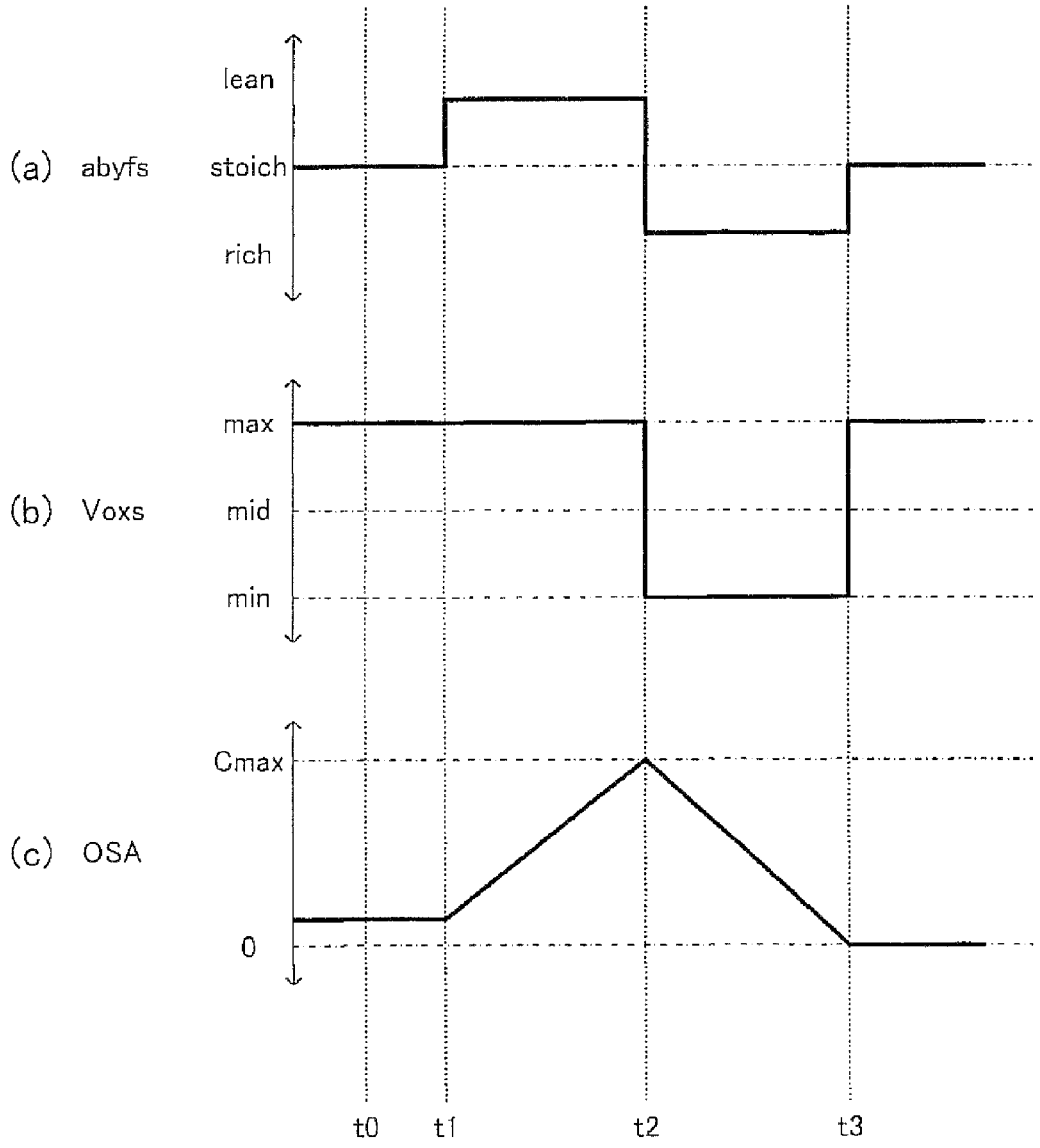
FIG. 12 is a time chart that shows the relationship among the upstream air-fuel ratio, the output value from the downstream oxygen concentration sensor and the oxygen storage amount of a catalyst.

FIG. 12 is a time chart that shows the relationship among the upstream air-fuel ratio abyfs, which is shown in a region (a), the output value Voxs from the downstream oxygen concentration sensor 67, which is shown in a region (b), and the oxygen storage amount OSA of the catalyst 43, which is shown in a region (c). It should be noted that the waveforms of actual values are schematically shown in FIG. 12 for easy understanding. At time t0 in this time chart, a "normal operation" is in progress, in which the air-fuel ratio (upstream air-fuel ratio abyfs) of the gas that is introduced into the catalyst is made equal to the stoichiometric air-fuel ratio "stoich". In the example that is shown in FIG. 12, it is assumed that at time t0, the output value Voxs from the downstream oxygen concentration sensor 67 is equal to the maximum output value "max", and the oxygen storage amount OSA is a predetermined value close to zero. Note that the predetermined value is a value which is determined depending on the operation at time to.

When the "catalyst deterioration level acquiring condition" is fulfilled at time t1, "catalyst deterioration level acquiring control" is started. Specifically, the third device controls the engine 10 at time t1 so that the air-fuel ratio of the gas that is introduced into the catalyst (upstream air-fuel ratio abyfs) becomes equal to the lean air-fuel ratio "lean".

As a result, the upstream air-fuel ratio abyfs becomes equal to the lean air-fuel ratio "lean" at time t1. At this time, because exhaust gas with the lean air-fuel ratio "lean" is introduced into the catalyst 43, the catalyst 43 stores excess oxygen that is contained in the exhaust gas. Thus, the oxygen storage amount OSA of the catalyst 43 increases with elapsed time after time t1. On the other hand, because substantially all the oxygen that is contained in the gas that is introduced into the catalyst is consumed at this time (because the amount of oxygen necessary to clean the exhaust gas is used in an oxidation reaction at the catalyst component and excess oxygen is stored in the catalyst 43), the gas that is discharged from the catalyst is substantially free of oxygen. Thus, the output value Voxs from the downstream oxygen concentration sensor 67 remains equal to the maximum output value max even after time t1.

In reality, it takes a specific length of time for the exhaust gas with an air-fuel ratio equal to the lean air-fuel ratio "lean" to reach the upstream oxygen concentration sensor 66 after the control for making the upstream air-fuel ratio abyfs equal to the lean air-fuel ratio "lean" is started. Thus, in reality, the air-fuel ratio abyfs of the gas that is introduced into the catalyst reaches the lean air-fuel ratio when the specific length of time has elapsed after time t1. In this description, however, it is assumed that the air-fuel ratio abyfs of the gas that is introduced into the catalyst instantly reaches the lean air-fuel ratio "lean" at time t1 for ease of understanding. In the following, description is continued on the assumption that "the length of time from the start of control to change the upstream air-fuel ratio abyfs to the time point when exhaust gas with an air-fuel ratio which has been changed as a result of the control reaches the upstream oxygen concentration sensor 66" is zero.

After that, the oxygen storage amount OSA of the catalyst 43 reaches the maximum oxygen storage amount Cmax at time t2. At this time, because the catalyst 43 can no more store excess oxygen that is contained in the gas that is introduced into the catalyst, the excess oxygen is discharged from the catalyst 43. Thus, the output value Voxs from the downstream oxygen concentration sensor 67 becomes a value which represents the lean air-fuel ratio "lean" (minimum output value "min" in this example) at time t2.

At time t2, the third device controls the engine 10 so that the air-fuel ratio of the gas that is introduced into the catalyst (upstream air-fuel ratio abyfs) becomes equal to the rich air-fuel ratio "rich".

As a result, the upstream air-fuel ratio abyfs reaches the rich air-fuel ratio "rich" at time t2. At this time, because exhaust gas with an air-fuel ratio equal to the rich air-fuel ratio "rich" is introduced into the catalyst 43, the catalyst 43 releases the stored oxygen for an oxidation reaction of the exhaust gas. Thus, the oxygen storage amount OSA of the catalyst 43 decreases with elapsed time after time t2. On the other hand, because the oxidation reaction occurs using the oxygen that is stored in the catalyst 43 at this time, the oxygen (unburned oxygen) that is contained in the gas that is introduced into the catalyst is not used for the oxidation reaction. Thus, the unburned oxygen that is contained in the gas that is introduced into the catalyst remains in the gas that is discharged from the catalyst. Thus, the output value Voxs from the downstream oxygen concentration sensor 67 remains equal to the minimum output value "min" even after time t2.

After that, the oxygen storage amount OSA of the catalyst 43 reaches zero at time t3. At this time, since substantially all the unburned oxygen that is contained in the gas that is introduced into the catalyst is used for the oxidation reaction of the exhaust gas, the gas that is discharged from the catalyst is substantially free of oxygen. Thus, the air-fuel ratio of the exhaust gas becomes a value which represents the rich air-fuel ratio "rich" (maximum output value "max" in this example) at time t3.

At time t3, the third device restarts the "normal operation." As a result, the upstream air-fuel ratio abyfs becomes equal to the stoichiometric air-fuel ratio "stoich" at or after time t3. The output value Voxs from the downstream oxygen concentration sensor 67 and the oxygen storage amount OSA of the catalyst 43 at or after time t3 depend on the operating state of the engine 10.

After performing the above operation, the third device calculates the maximum oxygen storage amount Cmax of the catalyst 43 according to the equations (14) and (15) below. The value 0.23 in the equation (14) represents the oxygen concentration (weight percent concentration) in air in the standard state, Fsum represents the accumulated value of the fuel injection amount within unit time Δt, abyfsave represents the average of the upstream air-fuel ratio abyfs within unit time Δt, and stoich represents the stoichiometric air-fuel ratio. In the equation (15), the right hand side of the equation represents the absolute value of the value that is obtained by integrating $\Delta O_2$ with respect to time t covering from time t2 to time t3.

$$\Delta O_2 = 0.23 \times F\mathrm{sum} \times (abyf\mathrm{save} - \mathrm{stoich}) \tag{14}$$

$$C\mathrm{max} = |\Sigma[t=t2,t3](\Delta O_2)| \tag{15}$$

As is evident from the right hand side of the equation (14), a "value $\Delta O_2$ which expresses the amount of oxygen that is contained in the exhaust gas that is introduced into the catalyst 43 per unit time with respect to the amount of oxygen that is contained in exhaust gas with the stoichiometric air-fuel ratio" is calculated by the equation (14). More briefly, $\Delta O_2$ is a value that represents the "excess or deficit of oxygen with respect to the amount of oxygen that is contained in exhaust gas with the stoichiometric air-fuel ratio." When the amount of oxygen is excessive, $\Delta O_2$ has a positive value. When the amount of oxygen is deficient, $\Delta O_2$ has a negative value. In other words, $\Delta O_2$ represents the amount of oxygen that is "stored" in the catalyst 43 per unit time when $\Delta O_2$ has a positive value, and $\Delta O_2$ represents the amount of oxygen that is "released" from the catalyst 43 per unit time when $\Delta O_2$ has a negative value.

Thus, the maximum oxygen storage amount Cmax of the catalyst 43 is calculated by integrating $\Delta O_2$ with respect to time t covering from time t2 (the moment at which the oxygen storage amount OSA is the maximum oxygen storage amount Cmax) to time t3 (the moment at which the oxygen storage amount OSA is zero) as shown by the equation (15) above. The foregoing is the method of acquiring the maximum oxygen storage amount Cmax of the catalyst 43.

2. Acquisition of Deterioration Level of Catalyst The third device acquires the deterioration level Dcat of the catalyst 43 based on the maximum oxygen storage amount Cmax that is acquired as described above. Specifically, the third device calculates the deterioration level Dcat of the catalyst 43 according to the equation (16) below. In the equation (16), Cmaxnew represents the maximum oxygen storage amount of the catalyst 43 when the catalyst 43 is new. Cmaxnew is preliminarily acquired through an experiment or the like.

$$Dcat=1-(Cmax/cmaxnew) \quad (16)$$

As is evident from the right hand side of the equation (16), the deterioration level Dcat is zero if the catalyst 43 is not deteriorated at all (in other words, Cmax and Cmaxnew are equal to each other). In contrast, the deterioration level Dcat increases as the degree of deterioration of the catalyst 43 increases (in other words, the difference between Cmax and Cmaxnew increases). The foregoing is the method of acquiring the deterioration level Dcat of the catalyst 43.

(Actual Operations) The actual operations of the third device are described below. In the third device, the CPU 71 performs repeatedly at respective specific intervals the routine for the fuel cutoff operation control that is shown in FIG. 5, the routine for estimation of catalyst temperature that is shown in FIG. 6, the routine for the fuel injection control that is shown in FIG. 7, the routine for the main feedback control that is shown in FIG. 8, the routine for the sub-feedback control that is shown in FIG. 9, the routine for acquisition of catalyst deterioration levels that is shown in FIG. 13, the routine for acquisition of the rich control parameter that is shown in FIG. 14, and the routine for the rich control that is shown in FIG. 15.

Figure 13:
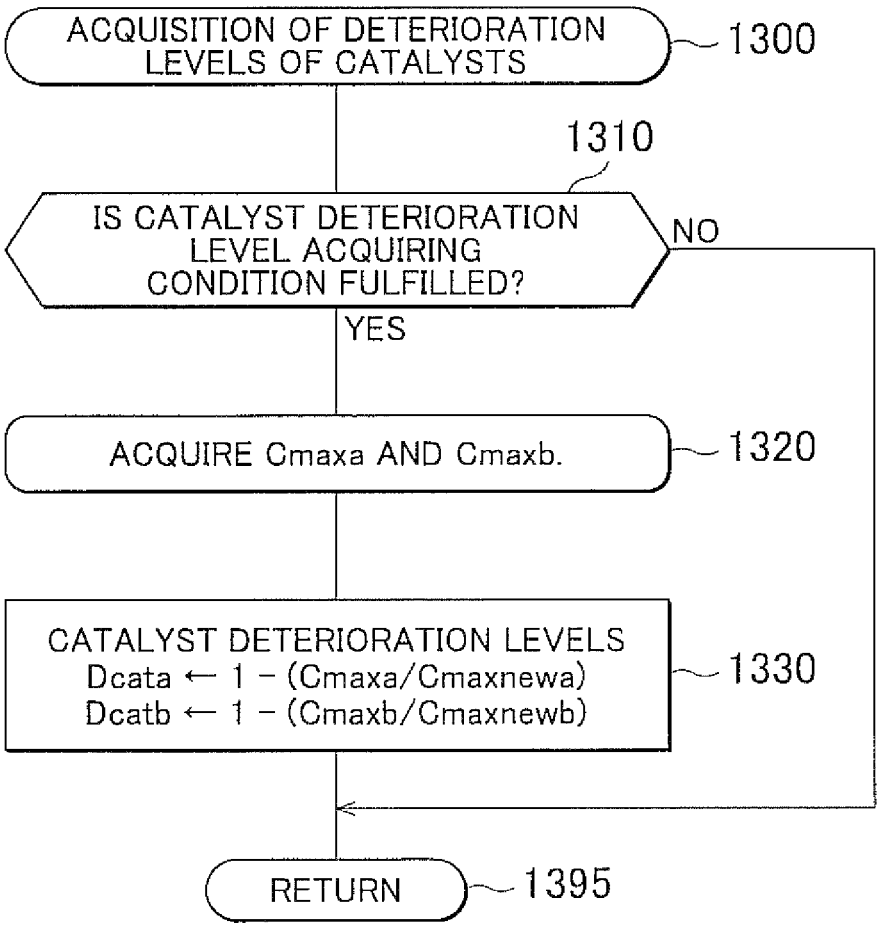
FIG. 13 is a flowchart that shows a routine which is performed by the CPU of a control device according to a third embodiment of the present invention.
Figure 14:
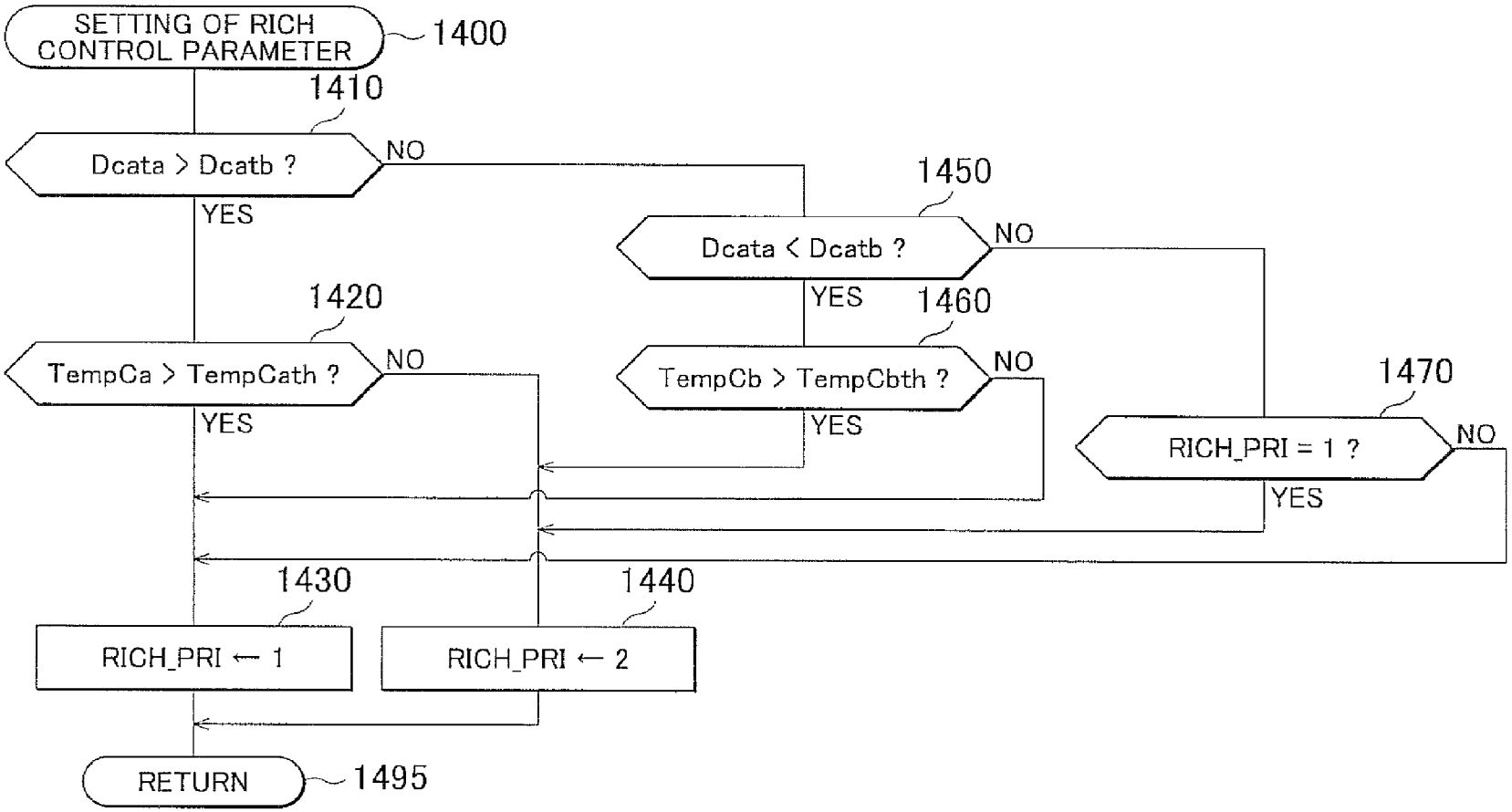
FIG. 14 is a flowchart that shows a routine which is performed by the CPU of the control device according to the third embodiment of the present invention.
Figure 15:
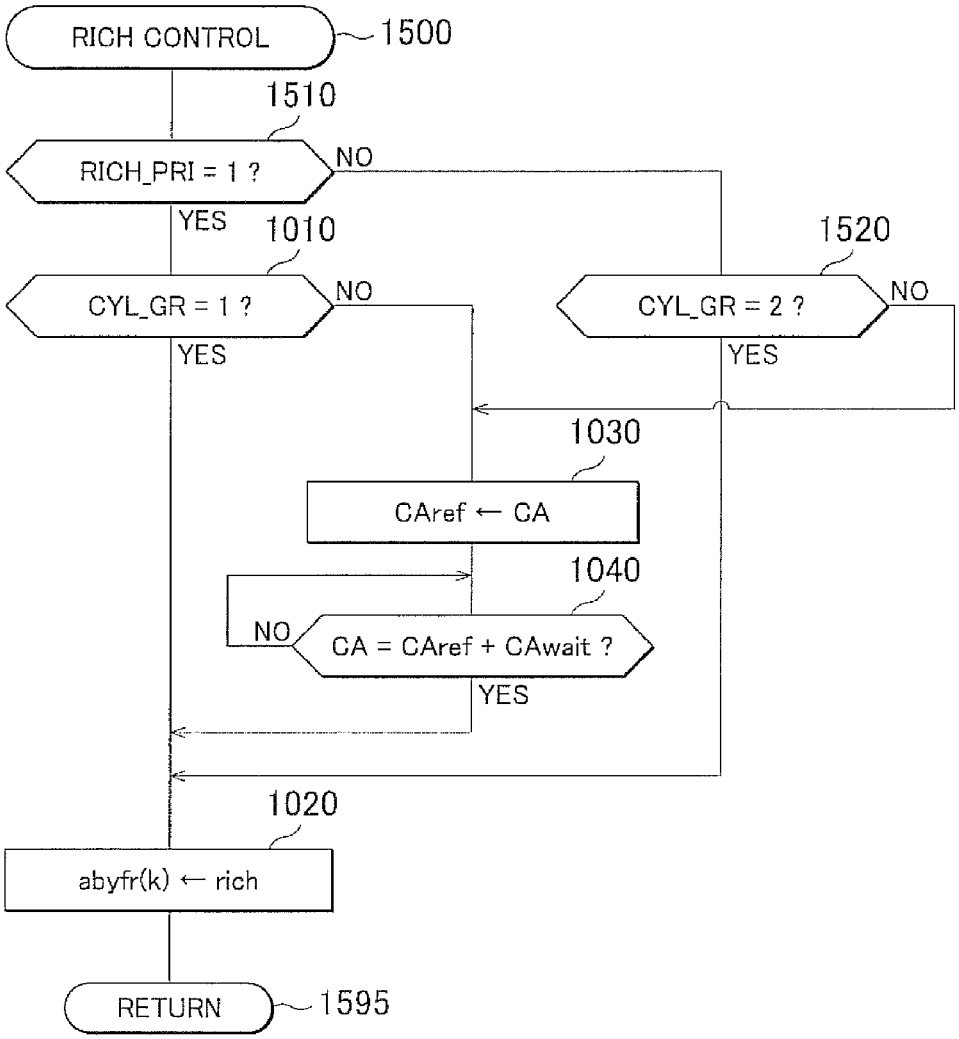
FIG. 15 is a flowchart that shows a routine which is performed by the CPU of the control device according to the third embodiment of the present invention.

The third device is different from the first device only in that the CPU 71 performs the flowcharts that are shown in "FIG. 13" and "FIG. 14", and in that it performs the flowchart that is shown in "FIG. 15" instead of the flowchart that is shown in FIG. 10. Thus, the routines that are performed by the CPU 71 are described below with a focus on the differences.

The CPU 71 performs the "catalyst deterioration level acquiring routine" that is shown as a flowchart in FIG. 13 repeatedly at predetermined time intervals. The CPU 71 uses this routine to acquire the deterioration level Dcata of the catalyst 43*a* and the deterioration level Dcatb of the catalyst 43*b*.

Specifically, the CPU 71 starts processing in step 1300 in FIG. 13 at a predetermined timing and proceeds to step 1310. In step 1310, the CPU 71 determines whether the "condition for acquiring the deterioration levels Dcata and Dcatb of the catalysts 43*a* and 43*b* (catalyst deterioration level acquiring condition)" is fulfilled. More specifically, the CPU 71 determines in step 1310 that the catalyst deterioration level acquiring condition is fulfilled when the following conditions d-1 to d-3 are all fulfilled. In other words, the CPU 71 determines that the catalyst deterioration level acquiring condition is not fulfilled when at least one of the conditions d-1 to d-3 is not fulfilled.

(Condition d-1): The coolant temperature THW is equal to or higher than a predetermined threshold value. (Condition d-2): The absolute value of the amount of change per unit time in the throttle valve opening TA is equal to or smaller than a predetermined threshold value. (Condition d-3): The absolute value of the amount of change per unit time in vehicle speed that is acquired by a vehicle speed sensor (not shown) is equal to or smaller than a predetermined threshold value.

The threshold value for the condition d-1 is set to a suitable value at which the engine 10 can be determined to have been wormed up. The threshold values for the conditions d-2 and d-3 are set to suitable values at which the engine 10 can be determined to be operating steadily.

When the deterioration level acquiring condition is not fulfilled at the present moment, the CPU 71 determines "No" in step 1310 and proceeds directly to step 1395 to terminate the current routine. Thus, when the deterioration level acquiring condition is not fulfilled, the deterioration levels Dcata and Dcatb of the catalysts 43*a* and 43*b* are not acquired.

In contrast, when the deterioration level acquiring condition is fulfilled at the present moment, the CPU 71 determines "Yes" in step 1310 and proceeds to step 1320. In step 1320, the CPU 71 acquires the maximum oxygen storage amount Cmaxa of the catalyst 43*a* and the maximum oxygen storage amount Cmaxb of the catalyst 43*b* according to the equations (14) and (15) above.

Next, the CPU 71 proceeds to step 1330. In step 1330, the CPU 71 acquires the deterioration level Dcata of the catalyst 43*a* according to the equation (16) based on the maximum oxygen storage amount Cmaxa of the catalyst 43*a* at the present moment and the maximum oxygen storage amount Cmaxnewa of the catalyst 43*a* when the catalyst 43*a* is new. Similarly, the CPU 71 acquires the deterioration level Dcatb of the catalyst 43*b* based on the maximum oxygen storage amount Cmaxb of the catalyst 43*b* at the present moment and the maximum oxygen storage amount Cmaxnewb of the catalyst 43*b* when the catalyst 43*b* is new. The maximum oxygen storage amounts Cmaxnewa and Cmaxnewb have been preliminarily acquired through an experiment or the like and stored in the ROM 72. After that, the CPU 71 proceeds to step 1395 and terminates the current routine.

In addition, the CPU 71 performs the routines that are shown in FIG. 5 through FIG. 9 as in the case of the first device. In this way, the fuel cutoff operation is performed when the fuel cutoff control condition (step 510 in FIG. 5) is fulfilled. Then, after the fuel cutoff operation is terminated, the CPU 71 performs the rich control taking into account the deterioration levels of the catalysts 43*a* and 43*b*.

Specifically, the CPU 71 performs the "routines that are shown in FIG. 14 and FIG. 15" in step 790 in FIG. 7 when the fuel cutoff operation is terminated (when the fuel cutoff control condition becomes unfulfilled). The CPU 71 uses the routine that is shown in FIG. 14 to determine a parameter used in the rich control (the numbers indicating the sequence in which the fuel injection cylinders are subjected to the rich control) based on, for example, the deterioration levels Dcata and Dcatb of the catalysts 43*a* and 43*b*. In addition, the CPU 71 uses the routine that is shown in FIG. 15 to adjust a timing of starting the rich control (first or second moment) depending on the fuel injection cylinder (depending on whether the fuel injection cylinder belongs to the first cylinder group or the second cylinder group).

Specifically, the CPU 71 starts processing in step 1400 in FIG. 14 and proceeds to step 1410. In step 1410, the CPU 71 determines whether the deterioration level Dcata of the catalyst 43*a* is higher than the deterioration level Dcatb of the catalyst 43*b*.

The processing operations that are performed in the routine in FIG. 14 when the deterioration level Dcata of the catalyst 43*a* is higher than the deterioration level Dcatb of the catalyst 43*b*, when the deterioration level Dcata of the catalyst 43*a* is lower than the deterioration level Dcatb of the catalyst 43*b*, and when the deterioration level Dcata of the catalyst 43*a* is equal the deterioration level Dcatb of the catalyst 43*b*, are described separately below.

1. When Deterioration Level Dcata of Catalyst 43*a* is Higher Than Deterioration Level Dcatb of Catalyst 43*b* In this case, the CPU 71 determines "Yes" in step 1410 and proceeds to step 1420. In step 1420, the CPU 71 determines whether the temperature TempCa of the catalyst 43*a* is higher than a threshold value TempCath. When the temperature TempCa of the catalyst 43*a* at the present moment is higher than the threshold value TempCath, the CPU 71 determines "Yes" in step 1420 and proceeds to step 1430. In step 1430, the CPU 71 stores "1" in a rich control priority number RICH_PRI. After that, the CPU proceeds to step 1495 and terminates the current routine.

In contrast, when the temperature TempCa of the catalyst 43*a* at the present moment is equal to or lower than the threshold value TempCath, the CPU 71 determines "No" in step 1420 and proceeds to step 1440. In step 1440, the CPU 71 stores "2" in the rich control priority number RICH_PRI. After that, the CPU proceeds to step 1495 and terminates the current routine.

The value (1 or 2) of the rich control priority number RICH_PRI is a value (cylinder group number) that indicates "which operation is to be started preferentially (earlier), the rich control in a cylinder that belongs to the first cylinder group, or the rich control in a cylinder that belongs to the second cylinder group." In other words, the rich control is to be preferentially started in a cylinder that belongs to the first cylinder group when the value of the rich control priority number RICH_PRI is "1", and the rich control is to be preferentially started in a cylinder that belongs to the second cylinder group when the value of the rich control priority number RICH_PRI is "2." The details are described later (refer to FIG. 15).

2. When Deterioration Level Dcata of Catalyst 43*a* is Lower Than Deterioration Level Dcatb of Catalyst 43*b* In this case, the CPU 71 determines "No" in step 1410 and proceeds to step 1450. In step 1450, the CPU 71 determines whether the deterioration level Dcata of the catalyst 43*a* is lower than the deterioration level Dcatb of the catalyst 43*b*. Then, the CPU 71 determines "Yes" in step 1450 and proceeds to step 1460.

In step 1460, the CPU 71 determines whether the temperature TempCb of the catalyst 43*b* is higher than a threshold value TempCbth. When the temperature TempCb of the catalyst 43*b* at the present moment is higher than the threshold value TempCbth, the CPU 71 determines "Yes" in step 1460 and proceeds to step 1440 to store "2" in the rich control priority number RICH_PRI.

When the temperature TempCb of the catalyst 43*b* at the present moment is equal to or lower than the threshold value TempCbth, the CPU 71 determines "No" in step 1460 and proceeds to step 1430 to store "1" in the rich control priority number RICH_PRI. After that, the CPU 71 proceeds to step 1495 and terminates the current routine.

3. When Deterioration Level Dcata of Catalyst 43*a* is Equal to Deterioration Level Dcatb of Catalyst 43*b* In this case, the CPU 71 determines "No" in step 1410 and step 1450 and proceeds to step 1470.

In step 1470, the CPU 71 determines whether the value of the rich control priority number RICH_PRI at the present moment (in other words, the rich control priority number RICH_PRI which was set when the routine in FIG. 14 was performed last time) is "1." When the value of the rich control priority number RICH_PRI at the present moment is "1," the CPU 71 determines "Yes" in step 1470 and proceeds to step 1440 to store "2" in the rich control priority number RICH_PRI.

In contrast, when the value of the rich control priority number RICH_PRI at the present moment is "2," the CPU 71 determines "No" in step 1470 and proceeds to step 1430 to store "1" in the value of the rich control priority number RICH_PRI. After that, the CPU proceeds to step 1495 and terminates the current routine.

As described above, in the case where the deterioration level Dcata of the catalyst 43*a* is "different" from the deterioration level Dcatb of the catalyst 43*b*, the "cylinder group number corresponding to the catalyst with a "higher" deterioration level is stored in the rich control priority number RICH_PRI" when the temperature of the catalyst with the higher deterioration level is higher than a predetermined threshold value, and the "cylinder group number corresponding to the catalyst with a "lower" deterioration level is stored in the rich control priority number RICH_PRI when the temperature of the catalyst with the higher deterioration level is equal to or lower than the predetermined threshold value. In contrast, in the case where the deterioration level Dcata of the catalyst 43*a* is equal to the deterioration level Dcatb of the catalyst 43*b*, "the cylinder group number "different from" the rich control priority number RICH_PRI set when the routine in FIG. 14 was performed last time" is stored in the rich control priority number RICH_PRI.

In addition, the CPU 71 performs the routine that is shown in FIG. 15. The routine that is shown in FIG. 15 is different from the routine that is shown in FIG. 10 only in that step 1510 and step 1520 are added. Thus, the steps in FIG. 15 in which the same processing operations as those performed in steps in FIG. 10 are designated by the same reference numerals as those that are used to designate the corresponding steps in FIG. 10. Detailed description of these steps is omitted when deemed unnecessary.

The CPU 71 starts processing in step 1500 in FIG. 15 and proceeds to step 1510. In step 1510, the CPU 71 determines whether the value of the rich control priority number RICH_PRI is "1." When the rich control priority number RICH_PRI at the present moment is "1," the CPU 71 determines "Yes" in step 1510 and proceeds to step 1010.

Then, when the cylinder group number CYL_GR of the fuel injection cylinder is "1," the CPU 71 determines "Yes" in step 1010 and immediately sets the upstream target air-fuel ratio abyfr(k) to the rich air-fuel ratio "rich" (step 1020). In contrast, when the cylinder group number CYL_GR of the fuel injection cylinder is "2," the CPU 71 determines "No" in step 1010 and sets the upstream target air-fuel ratio abyfr(k) to the rich air-fuel ratio "rich" after waiting for a time period corresponding to the waiting crank angle CAwait (step 1030 and step 1040).

As described above, when the value of the rich control priority number RICH_PRI is "1," the rich control is preferentially started in a cylinder with the cylinder group number CYL_GR "1." In other words, the fuel supply cycle which includes the moment at which the rich control is started in a cylinder that belongs to the first cylinder group is performed "before" performing the fuel supply cycle which includes the moment at which the rich control is started in a cylinder that belongs to the second cylinder group.

In contrast, when the value of the rich control priority number RICH_PRI at the present moment is "2," the CPU 71 determines "No" in step 1510 and proceeds to step 1520. In step 1520, the CPU 71 determines whether the cylinder group number CYL_GR of the fuel injection cylinder is "2."

Then, when the cylinder group number CYL_GR of the fuel injection cylinder is "2," the CPU 71 determines "Yes" in step 1520 and immediately sets the upstream target air-fuel ratio abyfr(k) to the rich air-fuel ratio "rich" (step 1020). In contrast, when the cylinder group number CYL_GR of the fuel injection cylinder is "1," the CPU 71 determines "No" in step 1520 and sets the upstream target air-fuel ratio abyfr(k) to the rich air-fuel ratio "rich" after waiting for a time period corresponding to the waiting crank angle CAwait (step 1030 and step 1040).

As described above, when the value of the rich control priority number RICH_PRI is "2," the rich control is preferentially started in a cylinder with the cylinder group number CYL_GR of "2." In other words, the fuel supply cycle which includes the moment at which the rich control is started in a cylinder that belongs to the first cylinder group is performed "after" performing the fuel supply cycle which includes the moment at which the rich control is started in a cylinder that belongs to the second cylinder group.

As described above, the third device sets the moment at which the rich control is started in a cylinder that belongs to the first cylinder group (i.e., first moment) and the moment at which the rich control is started in a cylinder that belongs to the second cylinder group (i.e., second moment) based on the deterioration levels Dcata and Dcatb of the catalysts 43*a* and 43*b*. Specifically, when the temperature of the catalyst with a higher deterioration level is higher than a predetermined threshold value, the rich control is preferentially started in a cylinder that belongs to the cylinder group corresponding to the catalyst with the higher deterioration level. In contrast, when the temperature of the catalyst with the higher deterioration level is equal to or lower than the predetermined threshold value, the rich control is preferentially started in a cylinder that belongs to the cylinder group corresponding to the catalyst with a lower deterioration level. The foregoing is the description of the third device.

Fourth Embodiment

An embodiment in which "the moments at which the rich control is started are set taking into account the deterioration levels of the catalysts and the total amounts of gas introduced into the catalysts during the fuel cutoff operation" is described as another specific example of the second device.

A control device according to this embodiment (which may also be referred to as "fourth device") is applied to an engine which has a configuration similar to that of the engine 10 (refer to FIG. 1) to which the first device is applied (the engine to which the fourth device is applied may also be hereinafter referred to as "the engine 10" for the sake of convenience).

(Actual Operations) The actual operations of the fourth device are described below. In the fourth device, the CPU 71 performs repeatedly the routine for the fuel cutoff operation control that is shown in FIG. 5, the routine for estimation of catalyst temperature that is shown in FIG. 6, the routine for the fuel injection control that is shown in FIG. 7, the routine for the main feedback control that is shown in FIG. 8, the routine for the sub-feedback control that is shown in FIG. 9, the routine for acquisition of catalyst deterioration levels that is shown in FIG. 13, the routine for acquisition of the rich control parameter that is shown in FIG. 16, and the routine for the rich control that is shown in FIG. 15, at respective specific intervals.

Figure 16:
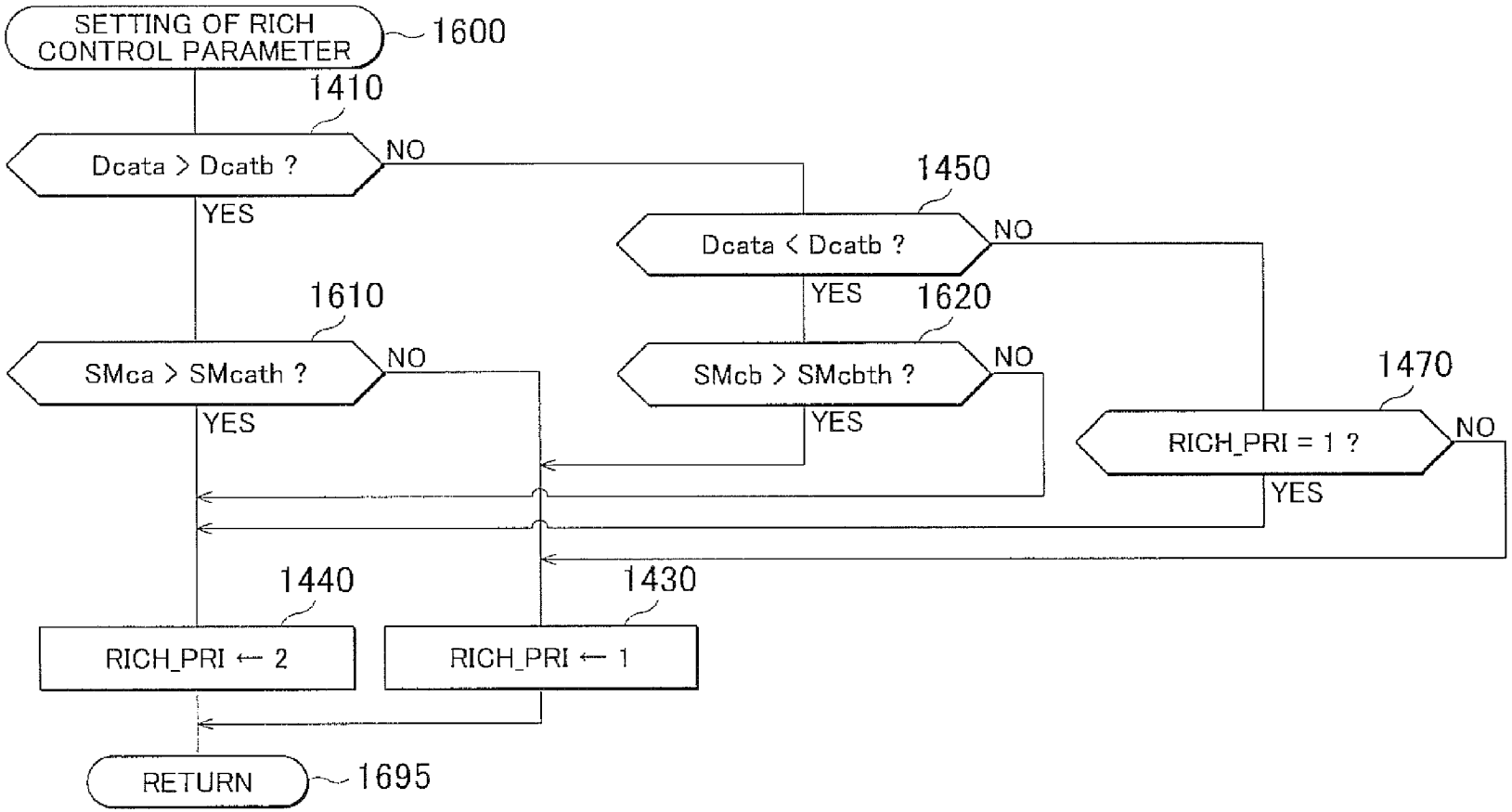
FIG. 16 is a flowchart that shows a routine which is performed by the CPU of a control device according to a fourth embodiment of the present invention.

The fourth device is different from the third device only in that the CPU 71 performs the flowchart that is shown in "FIG. 16" instead of the flowchart that is shown in FIG. 14. Thus, each of the routines that are performed by the CPU 71 is described below with a focus on the differences.

The CPU 71 performs the routines that are shown in FIG. 5 through FIG. 9 and FIG. 13 as in the case of the third device. As a result, the deterioration levels Dcata and Dcatb of the catalysts 43*a* and 43*b* are acquired and the fuel cutoff operation is performed when necessary. Then, when the fuel cutoff operation is terminated, the CPU 71 performs the rich control taking into account the deterioration levels Dcata and Dcatb of the catalysts 43*a* and 43*b*.

Specifically, the CPU 71 performs the "routines that are shown in FIG. 16 and FIG. 15" in step 790 in FIG. 7 when the fuel cutoff operation is terminated (when the fuel cutoff control condition becomes unfulfilled).

The routine that is shown in FIG. 16 is different from the routine that is shown in FIG. 14 only in that step 1420 is replaced by step 1610, step 1460 is replaced by step 1620, and some modifications are made in connection with the replacement of these steps (change of locations of step 1430 and step 1440 and change of the flows (arrows) in the drawing). Thus, the steps in FIG. 16 to perform the same processing operations as those in FIG. 14 are designated by the same reference numerals as those used to designate the corresponding steps in FIG. 14. Detailed description of these steps is omitted when deemed unnecessary.

Specifically, the CPU 71 starts processing in step 1600 in FIG. 16 and proceeds to step 1410. Then, when the deterioration level Dcata of the catalyst 43*a* is higher than the deterioration level Dcatb of the catalyst 43*b*, the CPU 71 determines "Yes" in step 1410 and proceeds to step 1610.

In step 1610, the CPU 71 determines whether a total amount SMca of the gas introduced into the catalyst 43*a* during the fuel cutoff operation is greater than a threshold value SMcath. When the total amount SMca at the present moment is greater than the threshold value SMcath, the CPU 71 determines "Yes" in step 1610 and proceeds to step 1440 to store "2" in the rich control priority number RICH_PRI.

In contrast, when the total amount SMca at the present moment is equal to or smaller than the threshold value SMcath, the CPU 71 determines "No" in step 1610 and proceeds to step 1430 to store "1" in the rich control priority number RICH_PRI.

On the other hand, when the deterioration level Dcata of the catalyst 43*a* is lower than the deterioration level Dcatb of the catalyst 43*b*, the CPU 71 determines "No" in step 1410 and "Yes" in step 1450 and proceeds to step 1620.

In step 1620, the CPU 71 determines whether a total amount SMcb of the gas introduced into the catalyst 43*b* during the fuel cutoff operation is greater than a threshold value SMcbth. When the total amount SMcb at the present moment is greater than the threshold value SMcbth, the CPU 71 determines "Yes" in step 1620 and proceeds to step 1430 to store "1" in the rich control priority number RICH_PRI.

In contrast, when the total amount SMcb at the present moment is equal to or smaller than the threshold value SMcbth, the CPU 71 determines "No" in step 1620 and proceeds to step 1440 to store "2" in the rich control priority number RICH_PRI.

When the deterioration level Dcata of the catalyst 43*a* is equal to the deterioration level Dcatb of the catalyst 43*b*, the CPU 71 proceeds to step 1470 and stores, in the rich control priority number RICH_PRI, a value different from the value set when the routine in FIG. 16 was performed last time, as in the case of the third device.

As described above, in the case where the deterioration level Dcata of the catalyst 43*a* is "different" from the deterioration level Dcatb of the catalyst 43*b*, the "cylinder group number corresponding to the catalyst with a 'lower' deterioration level" is stored in the rich control priority number RICH_PRI when the total amount of gas introduced into the catalyst with a higher deterioration level during the fuel cutoff operation is greater than a predetermined threshold value, and the "cylinder group number corresponding to the catalyst with the 'higher' deterioration level" is stored in the rich control priority number RICH_PRI when the total amount of gas introduced into the catalyst with the higher deterioration level during the fuel cutoff operation is equal to or smaller than the predetermined threshold value. In contrast, in the case where the deterioration level Dcata of the catalyst 43*a* is equal to the deterioration level Dcatb of the catalyst 43*b*, the cylinder group number "different" from the rich control priority number RICH_PRI set when the routine in FIG. 16 was performed last time is stored in the rich control priority number RICH_PRI.

In addition, the CPU 71 performs the routine that is shown in FIG. 15 as in the case of the third device. In this way, when the value of the rich control priority number RICH_PRI is "1," the fuel supply cycle which includes the moment at which the rich control is started in a cylinder that belongs to the first cylinder group is performed "before" performing the fuel supply cycle which includes the moment at which the rich control is started in a cylinder that belongs to the second cylinder group. In contrast, when the value of the rich control priority number RICH_PRI is "2," the fuel supply cycle which includes the moment at which the rich control is started in a cylinder that belongs to the first cylinder group is performed "after" performing the fuel supply cycle which includes the moment at which the rich control is started in a cylinder that belongs to the second cylinder group.

As described above, the fourth device sets the moment at which the rich control is started in a cylinder that belongs to the first cylinder group (i.e., first moment) and the moment at which the rich control is started in a cylinder that belongs to the second cylinder group (i.e., second moment) based on the deterioration levels Dcata and Dcatb of the catalysts 43*a* and 43*b*. Specifically, when the total amount of gas introduced into the catalyst with a higher deterioration level during the fuel cutoff operation is greater than the predetermined threshold value, the rich control is preferentially started in a cylinder that belongs to the cylinder group corresponding to the catalyst with a lower deterioration level. In contrast, when the total amount of gas introduced into the catalyst with the higher deterioration level during the fuel cutoff operation is equal to or smaller than the predetermined threshold value, the rich control is preferentially started in a cylinder that belongs to the cylinder group corresponding to the catalyst with the higher deterioration level. The foregoing is the description of the fourth device.

Fifth Embodiment

In the third and fourth embodiments that are described above, the moments at which the rich control is started are set taking into account the deterioration levels of the catalysts when the deterioration levels of the catalysts have been acquired. An embodiment in which "the rich control is performed based on the history of the rich control when the deterioration levels of the catalysts have not been acquired" is described below as yet another specific example of the second device.

As can be understood from the above description, the concept of the rich control in this embodiment is applicable to both the third and fourth embodiments. Thus, an embodiment in which the concept of the rich control in this embodiment is applied to the third embodiment (the third device) is described below as a representative example.

A control device according to this embodiment (which may also be referred to as "fifth device") is applied to an engine which has a configuration similar to that of the engine 10 (refer to FIG. 1) to which the first device is applied (the engine to which the fifth device is applied may also be hereinafter referred to as "the engine 10" for the sake of convenience).

(Actual Operations) The actual operations of the fifth device are described below. In the fifth device, the CPU 71 performs repeatedly the routine for the fuel cutoff operation control that is shown in FIG. 5, the routine for estimation of catalyst temperature that is shown in FIG. 6, the routine for the fuel injection control that is shown in FIG. 7, the routine for the main feedback control that is shown in FIG. 8, the routine for the sub-feedback control that is shown in FIG. 9, the routine for acquisition of catalyst deterioration levels that is shown in FIG. 13, the routine for acquisition of rich control parameter that is shown in FIG. 17, and the routine for the rich control that is shown in FIG. 15, at respective specific intervals.

Figure 17:
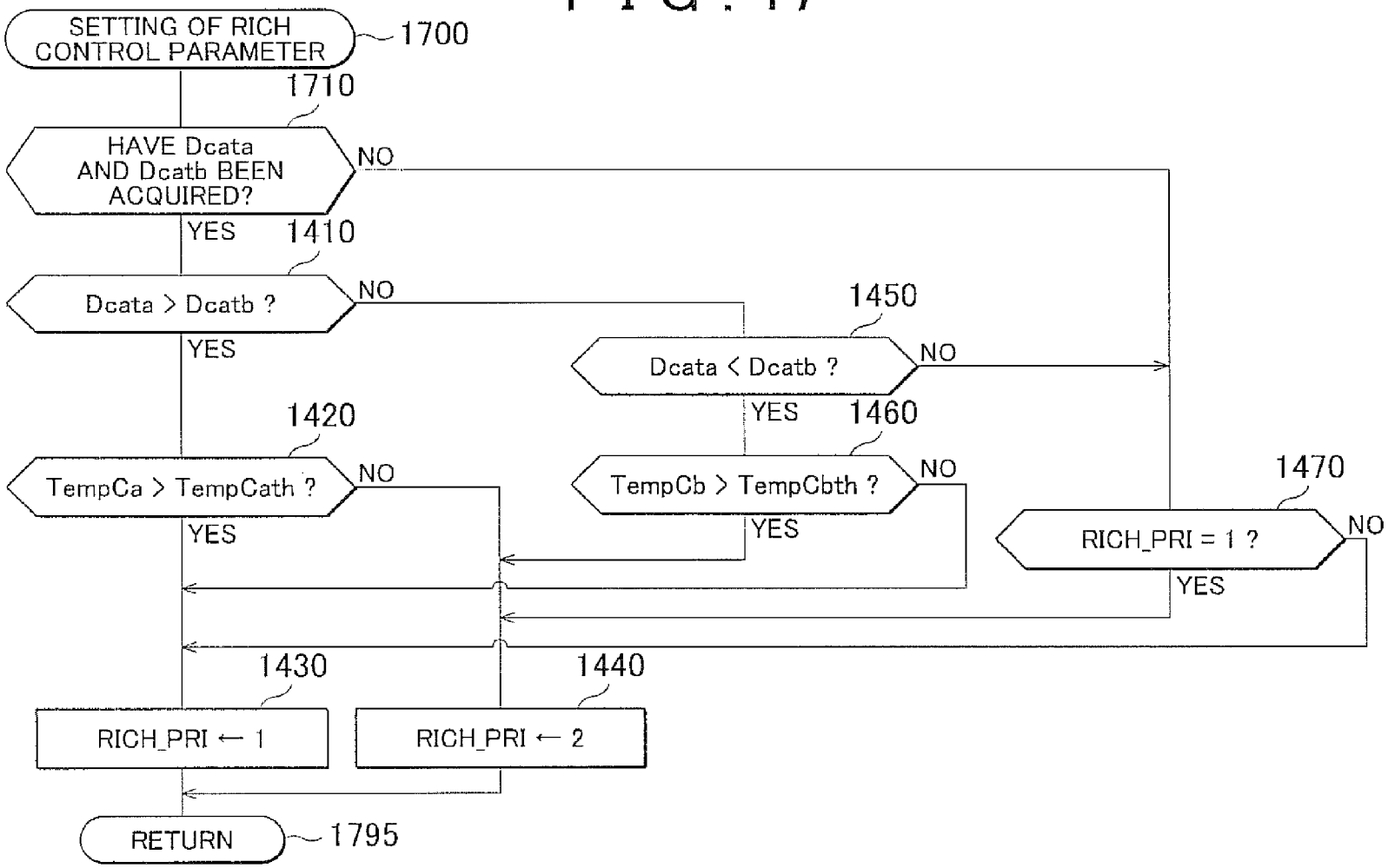
FIG. 17 is a flowchart that shows a routine which is performed by the CPU of a control device according to a fifth embodiment of the present invention.

The fifth device is different from the third device only in that the CPU 71 performs the flowchart that is shown in "FIG. 17" instead of the flowchart that is shown in FIG. 14. Thus, the routines that are performed by the CPU 71 are described below with a focus on the differences.

The CPU 71 performs the routines that are shown in FIG. 5 through FIG. 9 and FIG. 13 as in the case of the third device. As a result, the fuel cutoff operation is performed when necessary. Then, when the fuel cutoff operation is terminated, the CPU 71 performs the rich control taking into account the deterioration levels Dcata and Dcatb of the catalysts 43*a* and 43*b*.

Specifically, the CPU 71 performs the "routines that are shown in FIG. 17 and FIG. 15" in step 790 in FIG. 7 when it is time to start the rich control (when "1" is stored in the value of the rich operation flag XRICH).

The routine that is shown in FIG. 17 is different from the routine that is shown in FIG. 14 only in that step 1710 is added. Thus, the steps in FIG. 17 to perform the same processing operations as those in FIG. 14 are designated by the same reference numerals as those used to designate the corresponding steps in FIG. 14. Detailed description of these steps is omitted when deemed unnecessary.

Specifically, the CPU 71 starts processing in step 1700 in FIG. 17 and proceeds to step 1710. In step 1710, the CPU 71 determines whether both the deterioration level Dcata of the catalyst 43*a* and the deterioration level Dcatb of the catalyst 43*b* have been acquired.

When the deterioration level Dcata of the catalyst 43*a* and the deterioration level Dcatb of the catalyst 43*b* have been acquired at the present moment, the CPU 71 determines "Yes" in step 1710 and proceeds to step 1410. Then, the CPU 71 performs the processing operations in step 1410 through step 1470 as in the case of the third device. In other words, the CPU 71 sets the rich control priority number RICH_PRI based on the deterioration levels Dcata and Dcatb of the catalysts 43*a* and 43*b* and the temperatures of the catalysts 43*a* and 43*b*.

It should be noted that if the concept of the rich control in the fifth device is applied to the fourth device, the CPU 71 determines "Yes" in step 1710, and performs the processing operations in step 1410, step 1430 through step 1450, step 1470, step 1610 and step 1620 in the routine that is shown in FIG. 16. In other words, the CPU 71 sets the rich control priority number RICH_PRI based on the deterioration levels Dcata and Dcatb of the catalysts 43*a* and 43*b* and the total amounts of gas introduced into the catalyst 43*a* and 43*b* during the fuel cutoff operation.

In contrast, when at least one of the deterioration level Dcata of the catalyst 43*a* and the deterioration level Dcatb of the catalyst 43*b* has not been acquired at the present moment, the CPU 71 determines "No" in step 1710. Then, the CPU 71 proceeds to step 1470 and stores a value different from the rich control priority number RICH_PRI set when the routine in FIG. 17 was performed last time, as in the case of the third device.

In addition, the CPU 71 performs the routine that is shown in FIG. 15 as in the case of the third device. In this way, when the value of the rich control priority number RICH_PRI is "1," the fuel supply cycle which includes the moment at which the rich control is started in a cylinder that belongs to the first cylinder group is performed "before" performing the fuel supply cycle which includes the moment at which the rich control is started in a cylinder that belongs to the second cylinder group. In contrast, when the value of the rich control priority number RICH_PRI is "2," the fuel supply cycle which includes the moment at which the rich control is started in a cylinder that belongs to the first cylinder group is performed "after" performing the fuel supply cycle which includes the moment at which the rich control is started in a cylinder that belongs to the second cylinder group.

As described above, the fifth device sets the moment at which the rich control is started in a cylinder that belongs to the first cylinder group (i.e., first moment) and the moment at which the rich control is started in a cylinder that belongs to the second cylinder group (i.e., second moment) based on the deterioration levels Dcata and Dcatb of the catalysts 43*a* and 43*b*. Specifically, when at least one of the deterioration levels Dcata and Dcatb of the catalysts 43*a* and 43*b* has not been acquired, the rich control is preferentially performed in a cylinder that belongs to the cylinder group that is different from the cylinder group in which the rich control was preferentially started after the fuel cutoff operation that was performed immediately before the current fuel cutoff operation. The foregoing is the description of the fifth device.

Summary of Embodiments

As described with reference to FIG. 1 through FIG. 17, when the fuel cutoff operation in which supply of fuel to the combustion chamber of the engine 10 is cut off is terminated, and the supply of fuel to the combustion chamber is restarted (when "No" is selected in step 720 in FIG. 7), each of the control devices (first to fifth devices) according to the embodiments of the present invention performs the rich control in which the amount of fuel that is supplied to the combustion chamber is controlled so that the air-fuel mixture that is burned in the combustion chamber has the air-fuel ratio "rich" which is richer than the stoichiometric air-fuel ratio "stoich".

In the case where the control device of the present invention is applied to the engine 10 which includes a plurality of combustion chambers (a plurality of cylinders, refer to FIG. 1) and in which a fuel supply cycle in which fuel is sequentially supplied to the plurality of combustion chambers is repeated, the control device sets the first moment and the second moment such that the fuel supply cycle which includes the first moment is different from the fuel supply cycle which includes the second moment (refer to the routing in FIG. 10, for example), the first moment being a moment at which the rich control is started in the first combustion chamber of the plurality of combustion chambers (i.e., a cylinder that belongs to the first cylinder group), and the second moment being a moment at which the rich control is started in the second combustion chamber of the plurality of combustion chambers that is different from the first combustion chamber (i.e., a cylinder that belongs to the second cylinder group).

In the case where the engine 10 includes the first catalyst 43*a* into which gas from the first combustion chamber is introduced and the second catalyst 43*b* into which gas from the second combustion chamber is introduced, the control device of the present invention may be configured to set the first moment and the second moment based on the deterioration level Dcata of the first catalyst 43*a* and the deterioration level Dcatb of the second catalyst 43*b* (refer to the routine in FIG. 14, for example).

In addition, the control device of the present invention may be configured, in the case where the deterioration level Dcata of the first catalyst 43*a* is higher than the deterioration level Dcatb of the second catalyst 43*b*, to set the first moment and the second moment such that the fuel supply cycle which includes the first moment is performed before performing the fuel supply cycle which includes the second moment (i.e., to store "1" in the rich control priority number RICH_PRI) when at least the first catalyst 43*a* of the first and second catalysts 43*a* and 43*b* has the temperature TempCa higher than the threshold value TempCath (when "Yes" is determined in step 1420 in FIG. 14).

The control device of the present invention may be configured to set the first moment and the second moment such that the fuel supply cycle which includes the first moment is performed after performing the fuel supply cycle which includes the second moment (i.e., to store "2" in the rich control priority number RICH_PRI) when at least the first catalyst 43*a* has the temperature TempCa equal to or lower than the threshold value TempCath (when "No" is determined in step 1420 in FIG. 14) (refer to the routine in FIG. 14).

The control device of the present invention may be configured, in the case where the deterioration level Dcata of the first catalyst 43*a* is higher than the deterioration level Dcatb of the second catalyst 43*b*, to set the first moment and the second moment such that the fuel supply cycle which includes the first moment is performed after performing the fuel supply cycle which includes the second moment (i.e., to store "2" in the rich control priority number RICH_PRI) when the total amount SMca of gas introduced into at least the first catalyst 43*a* of the first and second catalysts 43*a* and 43*b* during the fuel cutoff operation is greater than the threshold amount SMcath (when "Yes" is determined in step 1610 in FIG. 16).

The control device of the present invention may be configured to set the first moment and the second moment such that the fuel supply cycle which includes the first moment is performed before performing the fuel supply cycle which includes the second moment (i.e., to store "1" in the rich control priority number RICH_PRI) when the total amount SMca of gas introduced into at least the first catalyst 43*a* during the fuel cutoff operation is equal to or smaller than the threshold amount SMcath (when "No" is determined in step 1610) (refer to the routine in FIG. 16).

The control device of the present invention may be configured, when at least either one of the deterioration level Dcata of the first catalyst 43*a* and the deterioration level Dcatb of the second catalyst 43*b* has not been acquired (when "No" is determined in step 1710 in FIG. 17) or when the deterioration level Dcata of the first catalyst 43*a* is equal to the deterioration level Dcatb of the second catalyst 43*b* (when "No" is determined in step 1410 and step 1450 in FIG. 17, for example), to set the first moment and the second moment that are associated with the current fuel cutoff operation based on history of the first moment and the second moment that are associated with the fuel cutoff operation performed prior to the current fuel cutoff operation (refer to the routine in FIG. 17).

For example, the control device of the present invention may be configured to set the first moment and the second moment that are associated with the current fuel cutoff operation such that the fuel supply cycle which includes the first moment is performed after performing the fuel supply cycle which includes the second moment, in the case where the fuel supply cycle which includes the first moment was performed before performing the fuel supply cycle which includes the second moment in association with the fuel cutoff operation that was performed immediately prior to the current fuel cutoff operation (when "Yes" is selected in step 1470 in FIG. 17).

The control device of the present invention may be configured to set the first moment and the second moment that are associated with the current fuel cutoff operation such that the fuel supply cycle which includes the first moment is performed before performing the fuel supply cycle which includes the second moment, in the case where the fuel supply cycle which includes the first moment was performed after performing the fuel supply cycle which includes the second moment in association with the fuel cutoff operation performed immediately prior to the current fuel cutoff operation (when "No" is determined in step 1470).

In the case where the engine 10 to which the control device of the present invention is applied includes a first combustion chamber group which is a group of a plurality of combustion chambers which includes the first combustion chamber (first cylinder group) and a second combustion chamber group which is a group of a plurality of combustion chambers which includes the second combustion chamber and does not include the combustion chambers that belong to the first combustion chamber group (second cylinder group), the control device of the present invention may be configured to start the rich control in the combustion chambers that belong to the first combustion chamber group in the fuel supply cycle which includes the first moment and to start the rich control in the combustion chambers that belong to the second combustion chamber group in the fuel supply cycle which includes the second moment.

The present invention is not limited to the above embodiments and may adopt various modifications within the scope thereof.

For example, the concept of the rich control that is applied to "one of the above embodiments (first to fourth embodiments) may adopt the concept of the rich control in "one or more of the other embodiments". In other words, one of the above embodiments may be combined with another embodiment or other embodiments.

In addition, the deterioration level of each catalyst is acquired based on the maximum oxygen intake of the catalyst, in other words, the maximum oxygen storage amount of the catalyst (refer to FIG. 13) in each of the above embodiments (second to fifth devices). However, the deterioration level of each catalyst may be acquired based on other information. For example, the deterioration level of each catalyst may be acquired based on the minimum value of the temperature of the catalyst that is required to reduce the amount of nitrogen oxides (NOx) in the gas introduced into the catalyst to a half (what is called NOx 50% conversion temperature).

In addition, the temperature of each catalyst is acquired based on the temperature of exhaust gas (refer to FIG. 6) in each of the above embodiments (first to fifth devices). However, the temperature of each catalyst may be acquired based on an output value from a temperature sensor that is used to acquire the temperature of the catalyst, for example.

In each of the above embodiments (second to fifth devices), the first and second moments that are associated with the current fuel cutoff operation may be set based on the history of the first and second moments that are associated with the (previous) fuel cutoff operation that was performed immediately prior to the current fuel cutoff operation (for example, step 1470 in FIG. 14). However, the "history" is not limited to the information on the first and second moments that are associated with the previous fuel cutoff operation. For example, the first and second moments that are associated with the current fuel cutoff operation may be set based on the history of the first and second moments that are associated with a plurality of fuel cutoff operations that were performed prior to the current fuel cutoff operation (so that the number of times the first moment has been set at an earlier time point and the number of times the second moment has been set at an earlier time point are equalized as much as possible, for example).

In each of the above embodiments (first to fifth devices), fuel is supplied to the engine 10 by the injectors 22, which inject fuel into intake ports. However, fuel may be supplied to the engine 10 by injectors which inject fuel directly into the cylinders (combustion chambers).

What is claimed is:

1. A control device for an internal combustion engine, which performs rich control to control an amount of fuel supplied to a combustion chamber of the internal combustion engine so that an air-fuel ratio of an air-fuel mixture burned in the combustion chamber is richer than a stoichiometric air-fuel ratio, when a fuel cutoff operation in which supply of the fuel to the combustion chamber is cut off is terminated and the supply of the fuel to the combustion chamber is restarted, wherein the fuel cutoff operation is performed when both (a-1) an accelerator pedal operation amount is equal to zero or a throttle valve opening is equal to zero and (a-2) an engine rotational speed is equal to or higher than a predetermined threshold value, wherein when the control device is applied to the internal combustion engine which includes a plurality of the combustion chambers and in which a fuel supply cycle in which the fuel is sequentially supplied to the plurality of combustion chambers is repeated, the control device sets a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers, which is different from the first combustion chamber wherein the internal combustion engine includes a first catalyst into which gas discharged from the first combustion chamber is introduced and a second catalyst into which gas discharged from the second combustion chamber is introduced, the control device sets the first moment and the second moment based on a deterioration level of the first catalyst and a deterioration level of the second catalyst;

wherein in a case when the deterioration level of the first catalyst is higher than the deterioration level of the second catalyst, the control device sets the first moment and the second moment such that the fuel supply cycle which includes the first moment is performed after performing the fuel supply cycle which includes the second moment when a total amount of the gas introduced into at least the first catalyst of the first and second catalysts during the fuel cutoff operation is greater than a threshold value amount, and the control device sets the first moment and the second moment such that the fuel supply cycle which includes the first moment is performed before performing the fuel supply cycle which includes the second moment when the total amount of the gas introduced into at least the first catalyst during the fuel cutoff operation is equal to or smaller than the threshold value amount.

2. The control device for the internal combustion engine according to claim 1, wherein in a case when the deterioration level of the first catalyst is higher than the deterioration level of the second catalyst, the control device sets the first moment and the second moment such that the fuel supply cycle which includes the first moment is performed before performing the fuel supply cycle which includes the second moment when at least the first catalyst of the first and second catalysts has a temperature higher than a threshold value temperature, and the control device sets the first moment and the second moment such that the fuel supply cycle which includes the first moment is performed after performing the fuel supply cycle which includes the second moment when at least the first catalyst has a temperature equal to or lower than the threshold value temperature.

3. The control device for the internal combustion engine according to claim 1, wherein when at least one of the deterioration level of the first catalyst and the deterioration level of the second catalyst has not been acquired or when the deterioration level of the first catalyst is equal to the deterioration level of the second catalyst, the control device sets the first moment and the second moment that are associated with the current fuel cutoff operation based on history of the first moment and the second moment that are associated with the fuel cutoff operation performed prior to the current fuel cutoff operation.

4. A control device for an internal combustion engine, which performs rich control to control an amount of fuel supplied to a combustion chamber of the internal combustion engine so that an air-fuel ratio of an air-fuel mixture burned in the combustion chamber is richer than a stoichiometric air-fuel ratio, when a fuel cutoff operation in which supply of the fuel to the combustion chamber is cut off is terminated and the supply of the fuel to the combustion chamber is restarted, wherein the fuel cutoff operation is performed when both (a-1) an accelerator pedal operation amount is equal to zero or a throttle valve opening is equal to zero and (a-2) an engine rotational speed is equal to or higher than a predetermined threshold value, wherein when the control device is applied to the internal combustion engine which includes a plurality of the combustion chambers and in which a fuel supply cycle in which the fuel is sequentially supplied to the plurality of combustion chambers is repeated, the control device sets a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers, which is different from the first combustion chamber;

wherein when at least one of the deterioration level of the first catalyst and the deterioration level of the second catalyst has not been acquired or when the deterioration level of the first catalyst is equal to the deterioration level of the second catalyst, the control device sets the first moment and the second moment that are associated with the current fuel cutoff operation based on history of the first moment and the second moment that are associated with the fuel cutoff operation performed prior to the current fuel cutoff operation;

wherein the control device sets the first moment and the second moment that are associated with the current fuel cutoff operation such that the fuel supply cycle which includes the first moment is performed after performing the fuel supply cycle which includes the second moment in a case where the fuel supply cycle which includes the first moment was performed before performing the fuel supply cycle which includes the second moment in association with the fuel cutoff operation performed immediately prior to the current fuel cutoff operation, and the control device sets the first moment and the second moment that are associated with the current fuel cutoff operation such that the fuel supply cycle which includes the first moment is performed before performing the fuel supply cycle which includes the second moment in a case where the fuel supply cycle which includes the first moment was performed after performing the fuel supply cycle which includes the second moment in association with the fuel cutoff operation performed immediately prior to the current fuel cutoff operation.

5. The control device for the internal combustion engine according to claim 1, wherein the internal combustion engine includes a first combustion chamber group which is a group of a plurality of the combustion chambers which includes the first combustion chamber and a second combustion chamber group which is a group of a plurality of the combustion chambers which includes the second combustion chamber and does not include the combustion chambers that belong to the first combustion chamber group, the rich control in the combustion chambers that belong to the first combustion chamber group is started in the fuel supply cycle which includes the first moment and the rich control in the combustion chambers that belong to the second combustion chamber group is started in the fuel supply cycle which includes the second moment.

6. A control device for an internal combustion engine, which performs rich control to control an amount of fuel supplied to a combustion chamber of the internal combustion engine so that an air-fuel ratio of an air-fuel mixture burned in the combustion chamber is richer than a stoichiometric air-fuel ratio, when a fuel cutoff operation in which supply of the fuel to the combustion chamber is cut off is terminated and the supply of the fuel to the combustion chamber is restarted, wherein when the control device is applied to the internal combustion engine which includes a plurality of the combustion chambers and in which a fuel supply cycle in which the fuel is sequentially supplied to the plurality of combustion chambers is repeated, the control device sets a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers, which is different from the first combustion chamber;

the internal combustion engine includes a first catalyst into which gas discharged from the first combustion chamber is introduced and a second catalyst into which gas discharged from the second combustion chamber is introduced, the control device sets the first moment and the second moment based on a deterioration level of the first catalyst and a deterioration level of the second catalyst;

wherein in a case when the deterioration level of the first catalyst is higher than the deterioration level of the second catalyst, the control device sets the first moment and the second moment such that the fuel supply cycle which includes the first moment is performed after performing the fuel supply cycle which includes the second moment when a total amount of the gas introduced into at least the first catalyst of the first and second catalysts during the fuel cutoff operation is greater than a threshold value amount, and the control device sets the first moment and the second moment such that the fuel supply cycle which includes the first moment is performed before performing the fuel supply cycle which includes the second moment when the total amount of the gas introduced into at least the first catalyst during the fuel cutoff operation is equal to or smaller than the threshold value amount.

7. A control device for an internal combustion engine, which performs rich control to control an amount of fuel supplied to a combustion chamber of the internal combustion engine so that an air-fuel ratio of an air-fuel mixture burned in the combustion chamber is richer than a stoichiometric air-fuel ratio, when a fuel cutoff operation in which supply of the fuel to the combustion chamber is cut off is terminated and the supply of the fuel to the combustion chamber is restarted, wherein when the control device is applied to the internal combustion engine which includes a plurality of the combustion chambers and in which a fuel supply cycle in which the fuel is sequentially supplied to the plurality of combustion chambers is repeated, the control device sets a first moment and a second moment such that the fuel supply cycle which includes the first moment is different from the fuel supply cycle which includes the second moment, the first moment being a moment at which the rich control is started in a first combustion chamber of the plurality of combustion chambers, and the second moment being a moment at which the rich control is started in a second combustion chamber of the plurality of combustion chambers, which is different from the first combustion chamber;

wherein the internal combustion engine includes a first catalyst into which gas discharged from the first combustion chamber is introduced and a second catalyst into which gas discharged from the second combustion chamber is introduced, the control device sets the first moment and the second moment based on a deterioration level of the first catalyst and a deterioration level of the second catalyst;

wherein when at least one of the deterioration level of the first catalyst and the deterioration level of the second catalyst has not been acquired or when the deterioration level of the first catalyst is equal to the deterioration level of the second catalyst, the control device sets the first moment and the second moment that are associated with the current fuel cutoff operation based on history of the first moment and the second moment that are associated with the fuel cutoff operation performed prior to the current fuel cutoff operation;

wherein the control device sets the first moment and the second moment that are associated with the current fuel cutoff operation such that the fuel supply cycle which includes the first moment is performed after performing the fuel supply cycle which includes the second moment in a case where the fuel supply cycle which includes the first moment was performed before performing the fuel supply cycle which includes the second moment in association with the fuel cutoff operation performed immediately prior to the current fuel cutoff operation, and the control device sets the first moment and the second moment that are associated with the current fuel cutoff operation such that the fuel supply cycle which includes the first moment is performed before performing the fuel supply cycle which includes the second moment in a case where the fuel supply cycle which includes the first moment was performed after performing the fuel supply cycle which includes the second moment in association with the fuel cutoff operation performed immediately prior to the current fuel cutoff operation.

8. The control device for the internal combustion engine according to claim 1, wherein the predetermined threshold value is set to a rotational speed at which the internal combustion engine is able to continue operation when the supply of fuel to the internal combustion engine is cut off.

9. The control device for the internal combustion engine according to claim 4, wherein in a case when the deterioration level of the first catalyst is higher than the deterioration level of the second catalyst, the control device sets the first moment and the second moment such that the fuel supply cycle which includes the first moment is performed before performing the fuel supply cycle which includes the second moment when at least the first catalyst of the first and second catalysts has a temperature higher than a threshold value temperature, and the control device sets the first moment and the second moment such that the fuel supply cycle which includes the first moment is performed after performing the fuel supply cycle which includes the second moment when at least the first catalyst has a temperature equal to or lower than the threshold value temperature.

10. The control device for the internal combustion engine according to claim 4, wherein when at least one of the deterioration level of the first catalyst and the deterioration level of the second catalyst has not been acquired or when the deterioration level of the first catalyst is equal to the deterioration level of the second catalyst, the control device sets the first moment and the second moment that are associated with the current fuel cutoff operation based on history of the first moment and the second moment that are associated with the fuel cutoff operation performed prior to the current fuel cutoff operation.

11. The control device for the internal combustion engine according to claim 4, wherein the internal combustion engine includes a first combustion chamber group which is a group of a plurality of the combustion chambers which includes the first combustion chamber and a second combustion chamber group which is a group of a plurality of the combustion chambers which includes the second combustion chamber and does not include the combustion chambers that belong to the first combustion chamber group, the rich control in the combustion chambers that belong to the first combustion chamber group is started in the fuel supply cycle which includes the first moment and the rich control in the combustion chambers that belong to the second combustion chamber group is started in the fuel supply cycle which includes the second moment.

12. The control device for the internal combustion engine according to claim 4, wherein the predetermined threshold value is set to a rotational speed at which the internal combustion engine is able to continue operation when the supply of fuel to the internal combustion engine is cut off.

* * * * *

UNITED STATES PATENT AND TRADEMARK OFFICE

CERTIFICATE OF CORRECTION

PATENT NO. : 8,949,000 B2
APPLICATION NO. : 13/626515
DATED : February 3, 2015
INVENTOR(S) : Takahiko Fujiwara It is certified that error appears in the above-identified patent and that said Letters Patent is hereby corrected as shown below:

In the Specification

In Column 21, Line 67, delete “teuninates”, and insert --terminates--, therefor.

Signed and Sealed this
Sixteenth Day of February, 2016

Michelle K. Lee

Michelle K. Lee
*Director of the United States Patent and Trademark Office*